US008770273B1

(12) United States Patent
Gibson

(10) Patent No.: US 8,770,273 B1
(45) Date of Patent: Jul. 8, 2014

(54) METHOD OF DRILLING AND OPERATING AN OIL OR GAS WELL, A METHOD OF PREVENTING OR MINIMIZING CONTAMINATION TO THE SOIL ABOUT AN OIL OR GAS WELL, USING A KIT TO INSTALL, AN IMPERVIOUS AND REUSABLE LINER AND APPARATUS THEREFOR

(71) Applicant: Ryan Gibson, Grindstone, PA (US)

(72) Inventor: Ryan Gibson, Grindstone, PA (US)

( * ) Notice: Subject to any disclaimer, the term of this patent is extended or adjusted under 35 U.S.C. 154(b) by 0 days.

(21) Appl. No.: 14/057,191

(22) Filed: Oct. 18, 2013

Related U.S. Application Data

(63) Continuation-in-part of application No. 13/826,602, filed on Mar. 14, 2013.

(60) Provisional application No. 61/668,594, filed on Jul. 6, 2012.

(51) Int. Cl.
*E02B 13/00* (2006.01)
*E02D 31/00* (2006.01)

(52) U.S. Cl.
CPC ..... *E02D 31/004* (2013.01)
USPC ..... 166/81.1; 166/75.11; 405/52

(58) Field of Classification Search
USPC ..... 166/81.1, 75.11; 405/52, 8
See application file for complete search history.

(56) References Cited

U.S. PATENT DOCUMENTS

| | | | | |
|---|---|---|---|---|
| 3,940,940 | A | 3/1976 | Barrett | |
| 4,765,775 | A | 8/1988 | Kroger | |
| 5,098,220 | A | 3/1992 | Norman | |
| 5,211,244 | A | 5/1993 | Arterbury | |
| 5,228,506 | A | 7/1993 | Pearce | |
| 5,441,108 | A | 8/1995 | Jenkins et al. | |
| 5,477,920 | A | 12/1995 | Simmons | |
| RE35,272 | E | 6/1996 | Mathieson et al. | |
| 6,286,593 | B1 | 9/2001 | Holtby | |
| 7,637,692 | B1 | 12/2009 | Rose | |
| 8,127,837 | B1 | 3/2012 | Rose | |
| 2012/0219746 | A1 * | 8/2012 | Powell | 428/57 |

* cited by examiner

*Primary Examiner* — Kenneth L Thompson
*Assistant Examiner* — Catherine Loikith
(74) *Attorney, Agent, or Firm* — Nils H. Ljungman & Associates

(57) ABSTRACT

A method of preventing or minimizing contamination to the soil about an oil or gas well, using a kit to install, an impervious and reusable liner and apparatus therefor. The abstract of the disclosure is submitted herewith as required by 37 C.F.R. §1.72(b). As stated in 37 C.F.R. §1.72(b): A brief abstract of the technical disclosure in the specification must commence on a separate sheet, preferably following the claims, under the heading "Abstract of the Disclosure." The purpose of the abstract is to enable the Patent and Trademark Office and the public generally to determine quickly from a cursory inspection the nature and gist of the technical disclosure. The abstract shall not be used for interpreting the scope of the claims. Therefore, any statements made relating to the abstract are not intended to limit the claims in any manner and should not be interpreted as limiting the claims in any manner.

20 Claims, 27 Drawing Sheets

METHOD OF DRILLING AND OPERATING AN OIL OR GAS WELL, A METHOD OF PREVENTING OR MINIMIZING CONTAMINATION TO THE SOIL ABOUT AN OIL OR GAS WELL, USING A KIT TO INSTALL, AN IMPERVIOUS AND REUSABLE LINER AND APPARATUS THEREFOR

CONTINUING APPLICATION DATA

This application is a continuation-in-part of U.S. application Ser. No. 13/826,602, filed Mar. 14, 2013, which claims priority to U.S. Provisional Application 61/668,594, filed Jul. 6, 2012. U.S. application Ser. No. 13/826,602 was pending at the time of filing of the present application.

BACKGROUND

1. Technical Field

The present application relates to a method of drilling and operating an oil or gas well, a method of preventing or minimizing contamination to the soil about an oil or gas well, using a kit to install, an impervious and reusable liner and apparatus therefor.

2. Background Information

Background information is for informational purposes only and does not necessarily admit that subsequently mentioned information and publications are prior art.

A well may be created by drilling a hole with a diameter in the range of about five inches to about fifty inches. A drilling rig may be used to drill the hole. The drilling rig may comprise a drill string with an attached drill bit. The drilling rig may rotate.

When an oil or gas well is drilled, prior to drilling, a large pit is dug around the actual drilling hole to form what is known in the industry as a well cellar. The well cellar usually has a circular shape, but can also be rectangular. The well cellar can have a depth of approximately six feet, which can be shallower or deeper as desired. The diameter may be rather large, such as approximately fifteen feet or more or less, or possibly about six to ten feet or more or less. The well cellar can be positioned underneath a drilling rig, and may be used to contain equipment such as blow out preventers, valves, and other equipment associated with drilling and other well operations. The well conductor pipe extends through generally the center of the bottom of the well cellar into the ground below.

After digging, the well cellar is then generally lined with wood, concrete, or metal, such as sheet metal or culvert pipe, or a combination thereof. For example, the side or sides of the well cellar can be completely covered with a layer of metal, and then a layer of concrete can be poured into the bottom of the well cellar to form a floor. The wood, concrete, or metal layer provides structural support to prevent collapse of the surrounding earth onto the equipment. The lining of the well cellar acts as a sealing structure which allows the well cellar to collect fluids from the drilling rig and production equipment, such as water, lubricants, drilling mud, completion fluids, oil, and/or other fluids or drilling liquids, to thereby minimize or prevent such contaminants from entering the soil or ground.

In addition, a containment layer of rubber, elastic, plastic, or other suitable material can be placed on the surface of the ground surrounding the cellar, to thereby cover the ground and minimize or prevent the entry of contaminant materials into the ground. However, such a containment layer is not connected to the well cellar, and thus contaminants can pass under the containment layer at the edge or lip of the well cellar and then into the surrounding soil. The containment layer may be used in conjunction with a lined well cellar, or can be used in an unlined well cellar. In either case, the containment layer can be extended to cover or line the interior surfaces of the well cellar to form a sealing structure or layer that allows the well cellar to collect fluids from the drilling rig and production equipment, such as water, lubricants, drilling mud, completion fluids, oil, and/or other fluids or drilling liquids, to thereby minimize or prevent such contaminants from entering the soil or ground.

OBJECT OR OBJECTS

An object of the present application may be to provide a method of minimizing, reducing, and/or preventing contamination of the soil surrounding an oil or gas well, well cellar, or pit.

SUMMARY

In at least one possible embodiment of the present application, a containment layer of rubber, elastic, plastic, or other suitable material can be extended over the lip of a well cellar such that the containment layer projects into the well cellar. A sealing ring may be disposed in the well cellar to press and hold the containment layer in place against the interior surface of the wall of the well cellar.

The sealing ring, holding ring, or clamping ring of the present application may comprise a plurality of curved elements. The curved elements may be configured to fit together and may be further configured to be adjustable to fit well cellars or pit structures of various diameters in various embodiments. Each of the curved elements may comprise unthreaded holes and threaded spindles disposed on opposite ends of the curved elements. The unthreaded holes are disposed on end faces of the curved elements. The threaded spindles of one curved element are configured to fit into the unthreaded holes of a second curved element. Upon a threaded spindle of a first curved element being disposed in an unthreaded hole of a second curved element, a nut disposed on a threaded spindle of the first curved element may be adjusted on the threaded spindle of the first curved element until the nut abuts the end face of the second curved element. This adjustment of nuts may permit the diameter of the sealing ring of the present application to be increased, decreased, or otherwise adapted as desired.

The above-discussed embodiments of the present invention will be described further herein below. When the word "invention" or "embodiment of the invention" is used in this specification, the word "invention" or "embodiment of the invention" includes "inventions" or "embodiments of the invention", that is the plural of "invention" or "embodiment of the invention". By stating "invention" or "embodiment of the invention", the Applicant does not in any way admit that the present application does not include more than one patentably and non-obviously distinct invention, and maintains that this application may include more than one patentably and non-obviously distinct invention. The Applicant hereby asserts that the disclosure of this application may include more than one invention, and, in the event that there is more than one invention, that these inventions may be patentable and non-obvious one with respect to the other.

BRIEF DESCRIPTION OF THE DRAWINGS

The present application is explained in greater detail below with reference to the accompanying drawings.

DESCRIPTION OF EMBODIMENT OR EMBODIMENTS

Figure 1:
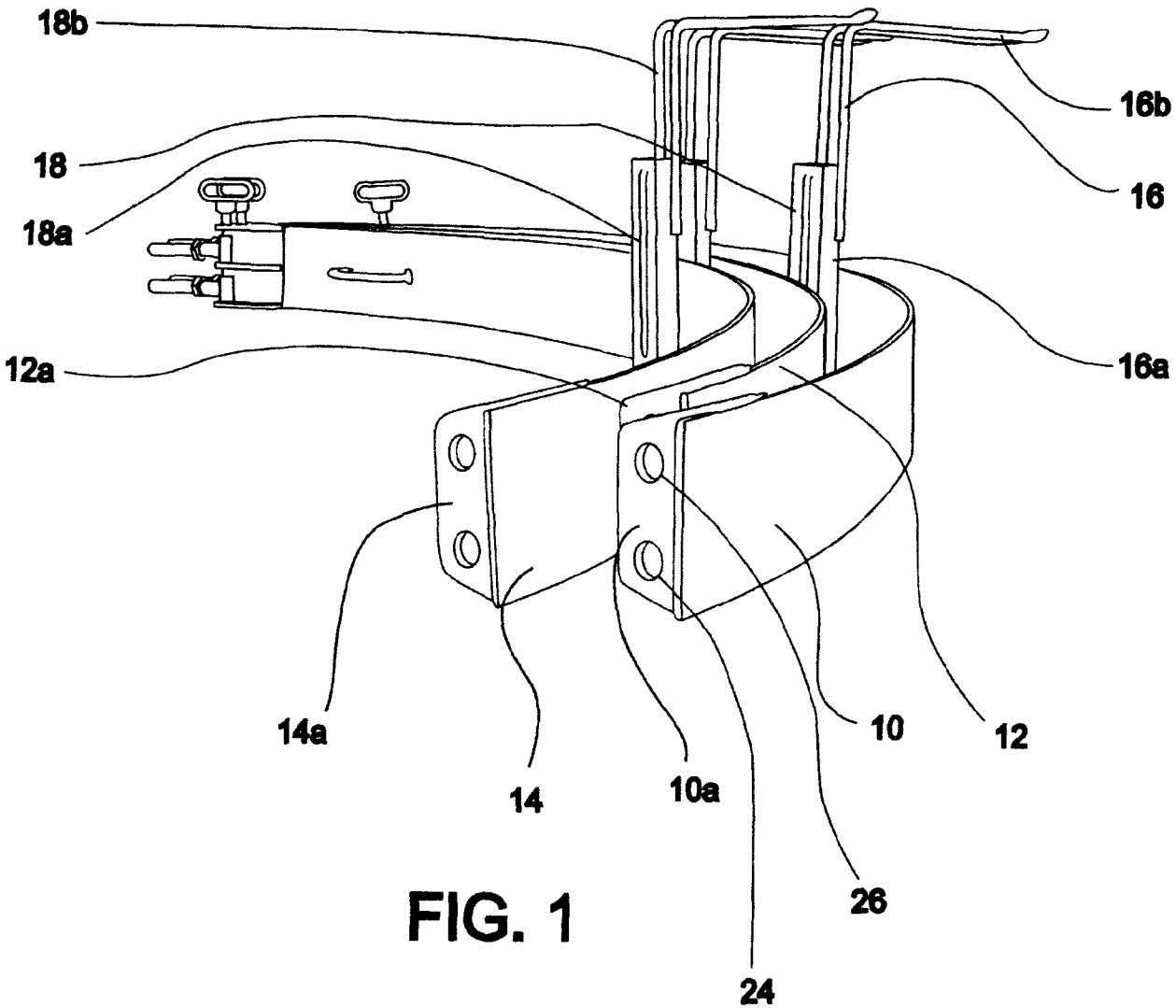
FIG. 1 shows a plurality of three curved segments which are designed to fit together to form a sealing ring including holes and end faces.

According to FIG. 1, there are shown three essentially one hundred twenty degree curved elements 10, 12, and 14, which are designed to fit together to form a sealing ring, holding ring, and/or clamping ring 1 (see FIG. 11), and also to hold a containment layer or liner in a secure position within the area at the top of the well cellar 31, or adjacent the top of the well cellar 31, or some distance from the top of the well cellar 31. The well cellar 31 is shown in other figures, such as FIG. 5. These elements 10, 12, and 14 are configured to line the well cellar 31 and hold the liner firmly in place to prevent or at least minimize mud and oil from escaping into the soil surrounding the well cellar 31. In order to hold the curved elements 10, 12, and 14 in place during assembly thereof and to provide support after assembly, there are a number of support elements 16 and 18 which suspend the curved elements 10, 12, and 14 from the surface of the soil around the well cellar 31. The support elements 16 and 18 each have a corresponding first, bottom portion 16*a* and 18*a*, which is rectangular in cross section, which cross section is greater than the cross section of top portions 16*b* and 18*b* to strengthen the support elements 16 and 18 and also to facilitate welding of 16*a* and 18*a* to its corresponding curved element 10, 12, or 14. The top portions 16*b* and 18*b* are round in cross section, which cross section permits the top portions 16*b* and 18*b* to be bent in any direction with essentially the same degree of force in order to conform the top portions 16*b* and 18*b* to the area about the well cellar 31. Each of the curved elements 10, 12, and 14 comprises a corresponding end face 10*a*, 12*a*, and 14*a* on one end of the curved elements 10, 12, and 14. Each of the end faces 10*a*, 12*a*, and 14*a* comprises two holes 24 and 26.

Figure 2:
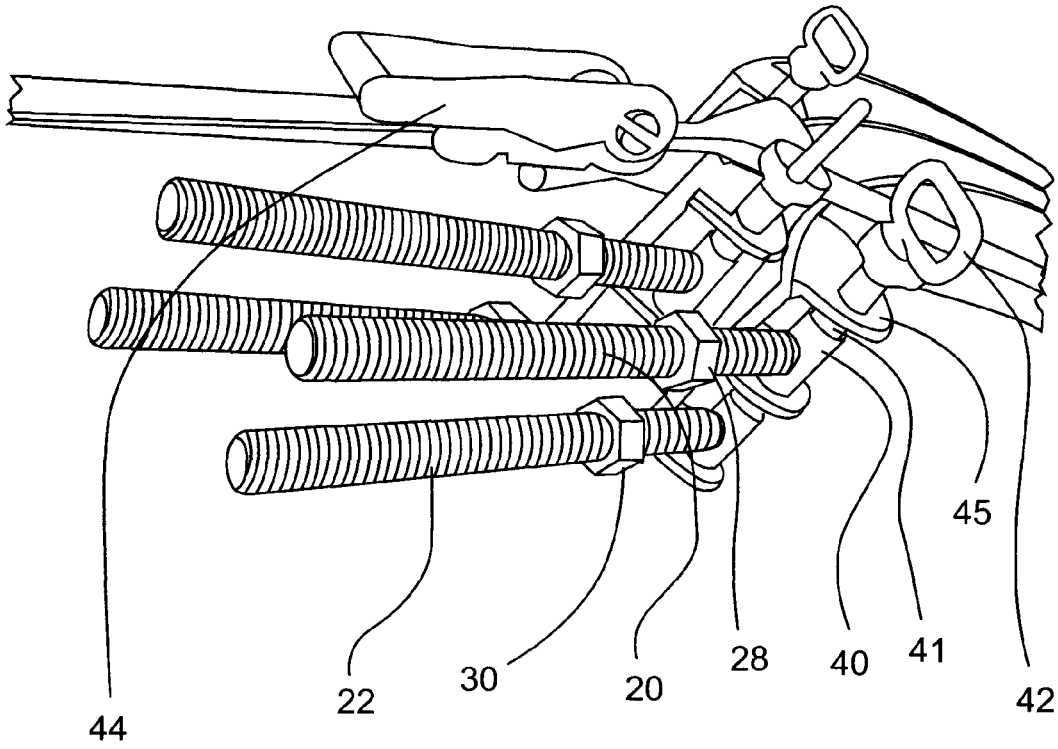
FIG. 2 shows a plurality of curved segments which are designed to fit together to form a sealing ring, including threaded spindles, spindles, and handles.

Referring now to FIG. 2, each of the curved elements 10, 12, 198 and 14 comprises two threaded spindles 20 and 22 extending from the end of the curved elements 10, 12, and 14 opposite the end faces 10*a*, 12*a*, and 14*a*. The threaded spindles 20 and 22 are configured to fit into the holes 24 and 26 as shown in FIG. 1. The holes 24 and 26 are sufficiently large in diameter and not threaded, allowing the threaded spindles 20 and 22 to enter these holes 24 and 26 unobstructedly. The nuts 28 and 30 shown in FIG. 2 are configured to be pressed against the end faces abutting the holes 24 and 26, thereby expanding the diameter formed by the curved elements 10, 12, and 14 against the plastic sheet liner or containment layer in order to press the plastic sheet liner toward the wall of the well cellar 31 to hold the plastic sheet liner firmly in place.

The threaded spindles 20 and 22 are welded to sleeves 40 and aligned on these sleeves 40 such that the threaded spindles 20 and 22 are parallel or substantially parallel. A support pin or spindle 41 is inserted through holes in support flanges 45 and through the sleeves 40. The support pin 41 is retained by a handle 42 on one end and by a retaining structure 46, such as a locking pin, on the other end. The support flanges 45 form part of or are connected to each of the curved elements 10, 12, and 14. The threaded spindles 20 and 22 can have their position adjusted by rotation or pivoting about the support pin 41 during insertion of the threaded spindles 20 and 22 into the holes 24 and 26, which are disposed in an adjacent end of another one of the curved elements 10, 12, and 14. A strap mechanism 44 is also shown which does not form part of the embodiment shown in FIG. 2.

Figure 2A:
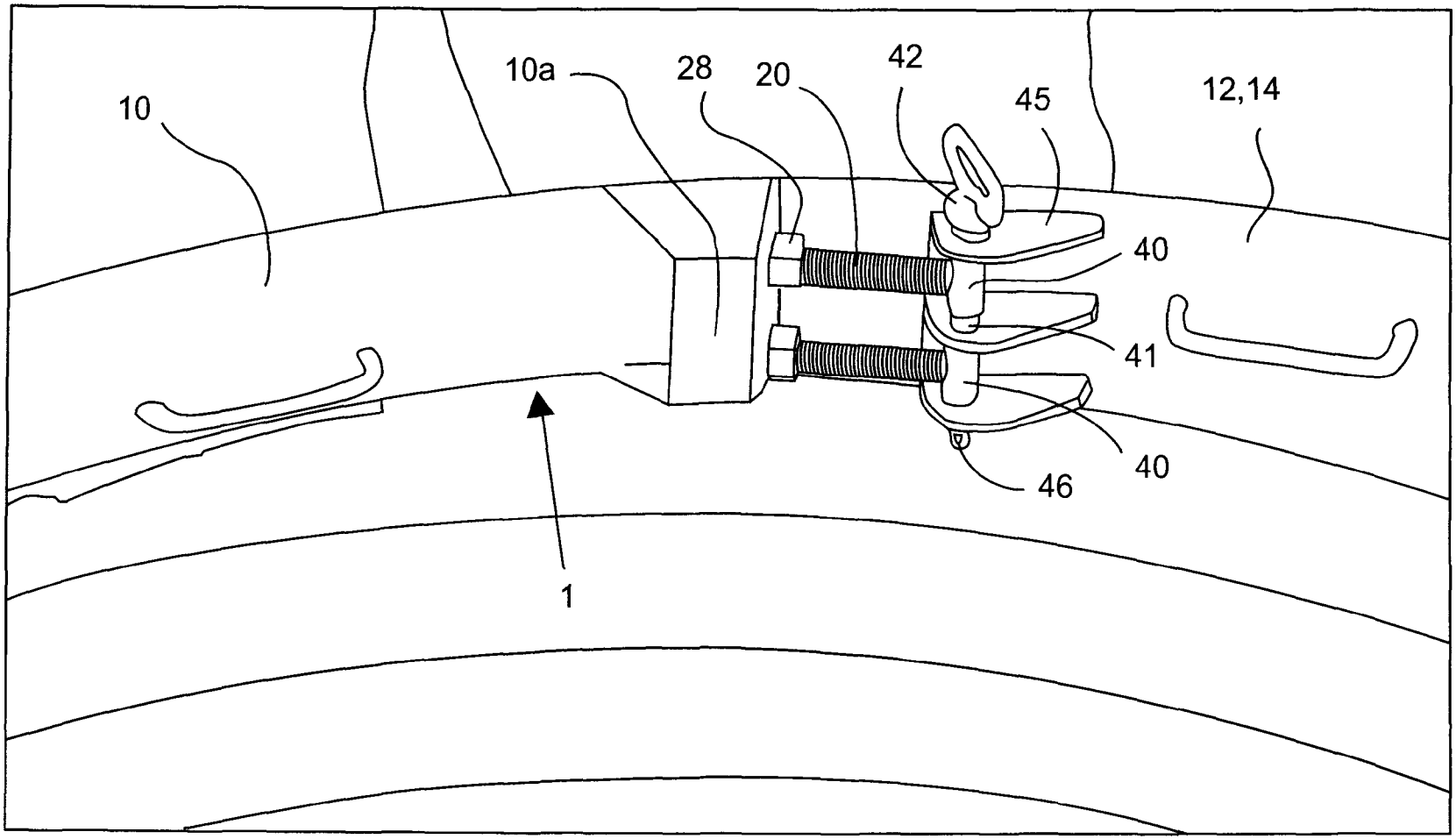
FIG. 2A shows a close-up view of two of the curved segments installed in a well cellar.

FIG. 2A shows a close-up view of two of the curved segments 10, 12, and 14 installed in a well cellar 31. Two parts or sections of the sealing ring 1 are shown, specifically curved portion 10 connected to one of the other curved portions 12 or 14. The threaded spindles 20, 22 are inserted into the holes 24, 26 (see FIG. 1) in the end face or support bracket 10*a*. The nuts 43 have been adjusted to increase the sealing or pressing force of the sealing ring 1 against the foam (not shown) by expansion of the sealing ring 1.

Figure 3:
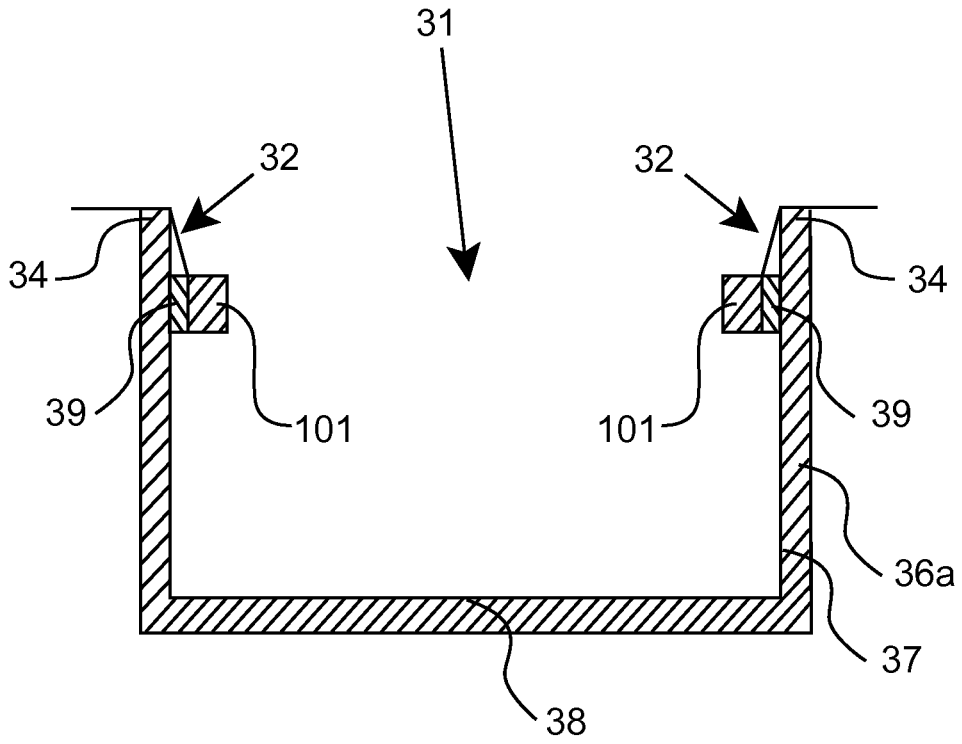
FIG. 3 shows a schematic cross-section of a well cellar with an installed sealing ring.
Figure 3A:
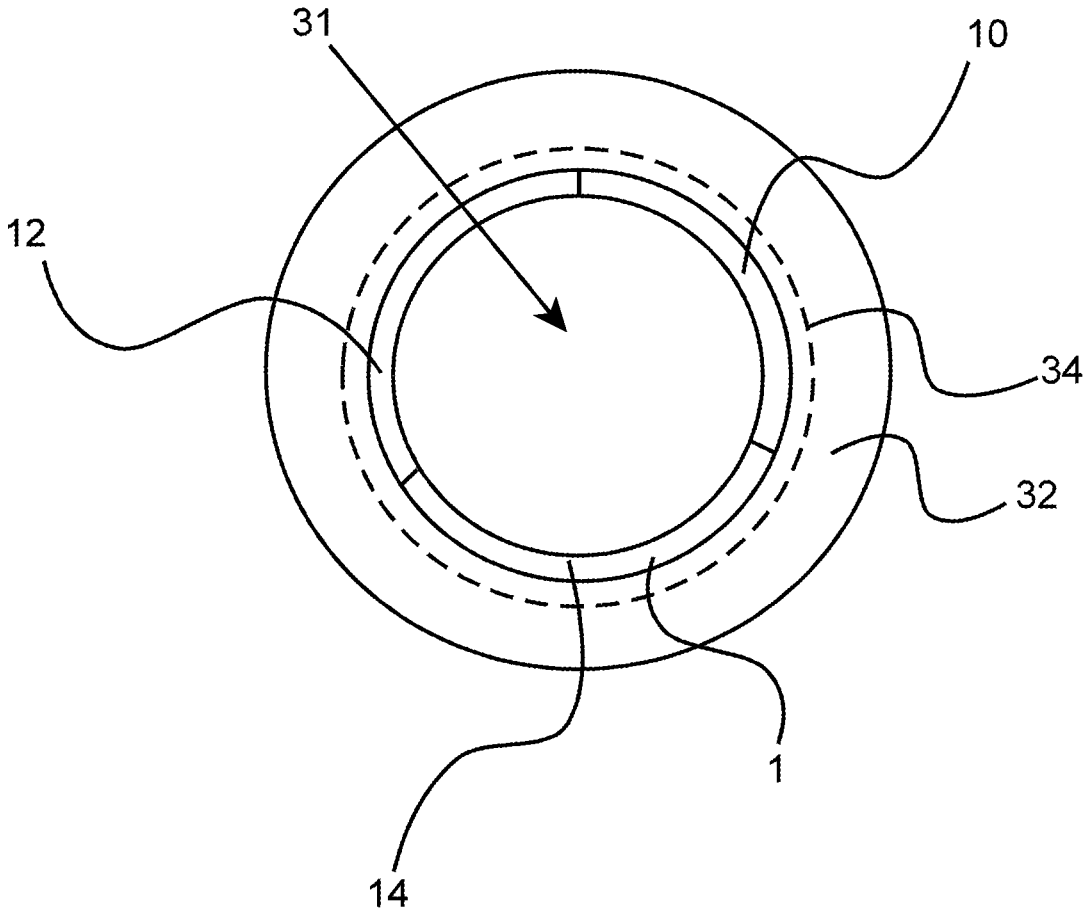
FIG. 3A shows a sealing ring disposed in a well cellar.

FIG. 3 shows a schematic cross-section of a possible embodiment of a well cellar 31, portions of which have been exaggerated to permit viewing of different features. The well cellar 31 has sides 37 and a bottom 38. The well cellar 31 has a sealing arrangement that comprises a liner 36*a* made of wood, concrete, metal, or a combination thereof. The sealing ring 1 is installed and pressed against a foam layer 39 sandwiched between the sealing ring 1 and the interior surface of the liner 36*a*. A containment layer 32 is shown in an exaggerated manner and extending over the lip or edge 34 of the well cellar 31, which containment layer 32 is clamped or pressed or held in place between the sealing ring 1 and the foam layer 39. A drilling rig as shown in U.S. Pat. No. 7,987,904 may be placed above the well cellar 31, with portions of the drilling rig extending downwardly through the center of the bottom 38 of the well cellar 31. FIG. 3A shows a schematic top view of the well cellar 31 with the three curved elements 10, 12, and 14 of the sealing ring 1 installed therein and holding the containment layer 32 in place. Again, FIGS. 3 and 3A are schematic views which show at least one possible arrangement of components and should not be considered as limiting of the other embodiments disclosed herein.

By holding the containment layer 32 in place during drilling, leakage of mud, oil, or other drilling fluids out of the well cellar 31 and under the containment layer 32 will be prevented or minimized. Such fluids will then be deposited on top of the containment layer 32 where the fluids can easily be pumped out and will not contaminate the soil around the well cellar 31.

Upon the drilling operation being complete or stopped for a length of time by withdrawing the drilling equipment from the drilling site, the curved elements 10, 12, and 14 can be removed, thus allowing the containment layer 32 to be removed from the well cellar 31. In the event of further drilling in such a well where the containment layer 32 has been removed, the same containment layer or a new containment layer could be installed, which would permit the continuation of a drilling operation.

The size of the curved elements 10, 12, and 14 would be determined by the need for stability of the curved elements 10, 12, and 14 in installation and functioning to hold the containment layer 32 in position at least during a drilling operation. Also, the roughnecks or workers who are conducting the drilling may also use the curved elements 10, 12, and 14 as a step to enter the well cellar 31. Therefore, the strength, that is, the thickness and height of the curved elements 10, 12, and 14, would have to be sufficient to support a number of roughnecks using the installed curved elements 10, 12, and 14 as steps used for entering and leaving the well cellar 31. The spindles 20 and 22 also must be sufficiently strong to perform the operation of installing the curved elements 10, 12, and 14 and the stress of roughnecks working in the well cellar 31 from disturbing the location of the curved elements 10, 12, and 14 for the same reasons as discussed immediately above. Further, the thickness and strength of the curved elements 10, 12, and 14 should not be so heavy that installation becomes difficult for the installers such as the roughnecks.

The three curved elements 10, 12, and 14 are one embodiment disclosed in the present application, but there may be other embodiments which have a greater or smaller number of curved elements, such as, but not limited to, two, four, or even a greater number which would form a kit, similar to the kit described herein having the three curved elements 10, 12, and 14, to accomplish the minimization of contamination of the soil during and after drilling of an oil or gas well.

Figure 4:
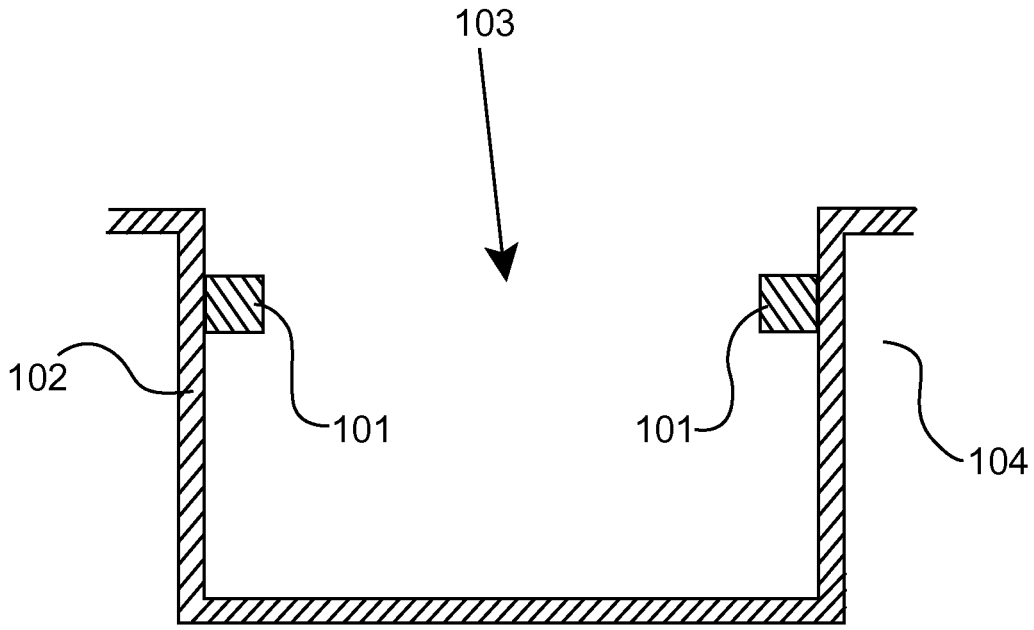
FIG. 4 shows a schematic cross-section of a well cellar with an installed sealing ring.
Figure 4A:
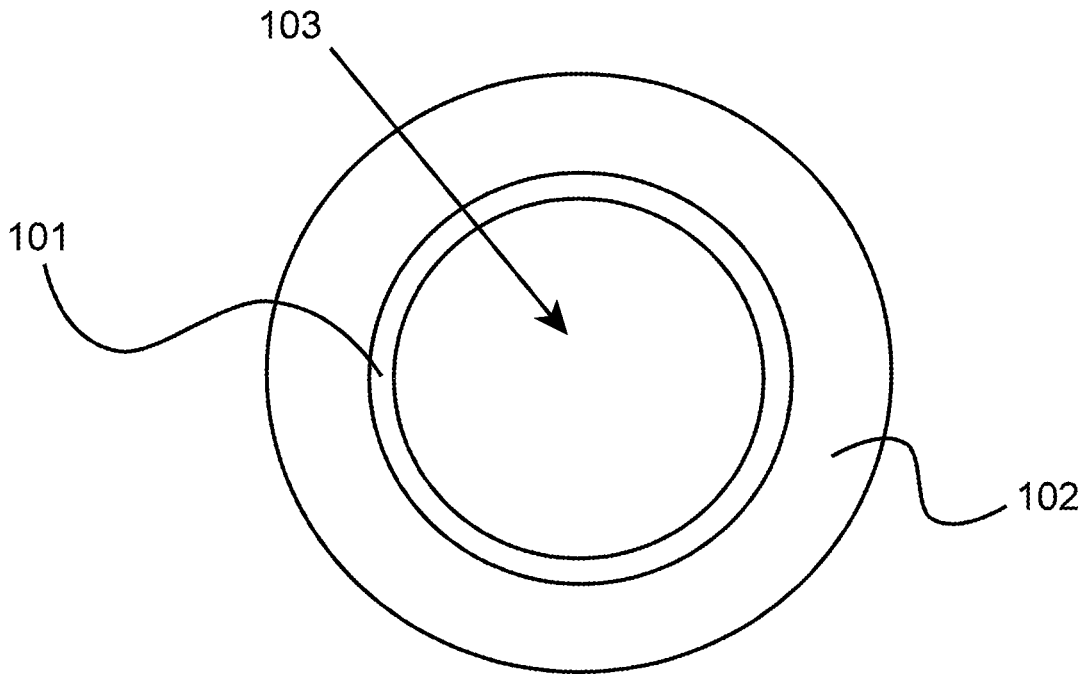
FIG. 4A shows a sealing ring disposed in a well cellar.

FIG. 4 shows a schematic cross-section of another possible embodiment of a well cellar 103, portions of which have been exaggerated to permit viewing of different features. The well cellar 103 is essentially a pit dug into the ground or soil 104 at a drilling site. The well cellar 103 is lined with a liner or sealing structure 102 which seals the well cellar 103 to minimize or prevent leakage of oil and/or drilling mud and/or drilling fluids into the soil 104 about the well cellar 103. The sealing structure 102 can be made from a variety of materials and/or a combination thereof, such as wood, metal, plastic, rubber, concrete, so long as these materials provide a seal that is sufficiently impervious to minimize or prevent leakage or passage of oil and/or drilling mud and/or drilling fluids through or by the sealing structure 102. In one possible embodiment, the sealing structure or liner 102 can be made of a plastic or rubber or elastic material that is sufficiently durable to resist tearing and sufficiently impervious to minimize or prevent leakage or passage of oil and/or drilling mud and/or drilling fluids therethrough. Such a liner 102 can be designed to extend from the top surface of the ground 104 surrounding the well cellar 103, over the edge or lip of the well cellar 103, down into and covering the side surface of the well cellar 103, and across the bottom surface or floor of the well cellar 103. Regardless of the design of the liner or sealing structure 102, an adjustable sealing arrangement 101 can be installed and pressed against a portion of said sealing structure 102 to assist in sealing a portion of said sealing structure 102. In one possible embodiment, the sealing arrangement 101 is in the form of an expandable ring, the diameter of which can be expanded to cause the ring to press against a portion of the sealing structure 102. The pressing force of the expandable ring acts to press and hold the sealing structure 102 in place against unwanted movement thereof, and acts to assist in sealing the portion of the sealing structure 102 contacted by the expandable ring.

Figure 5:
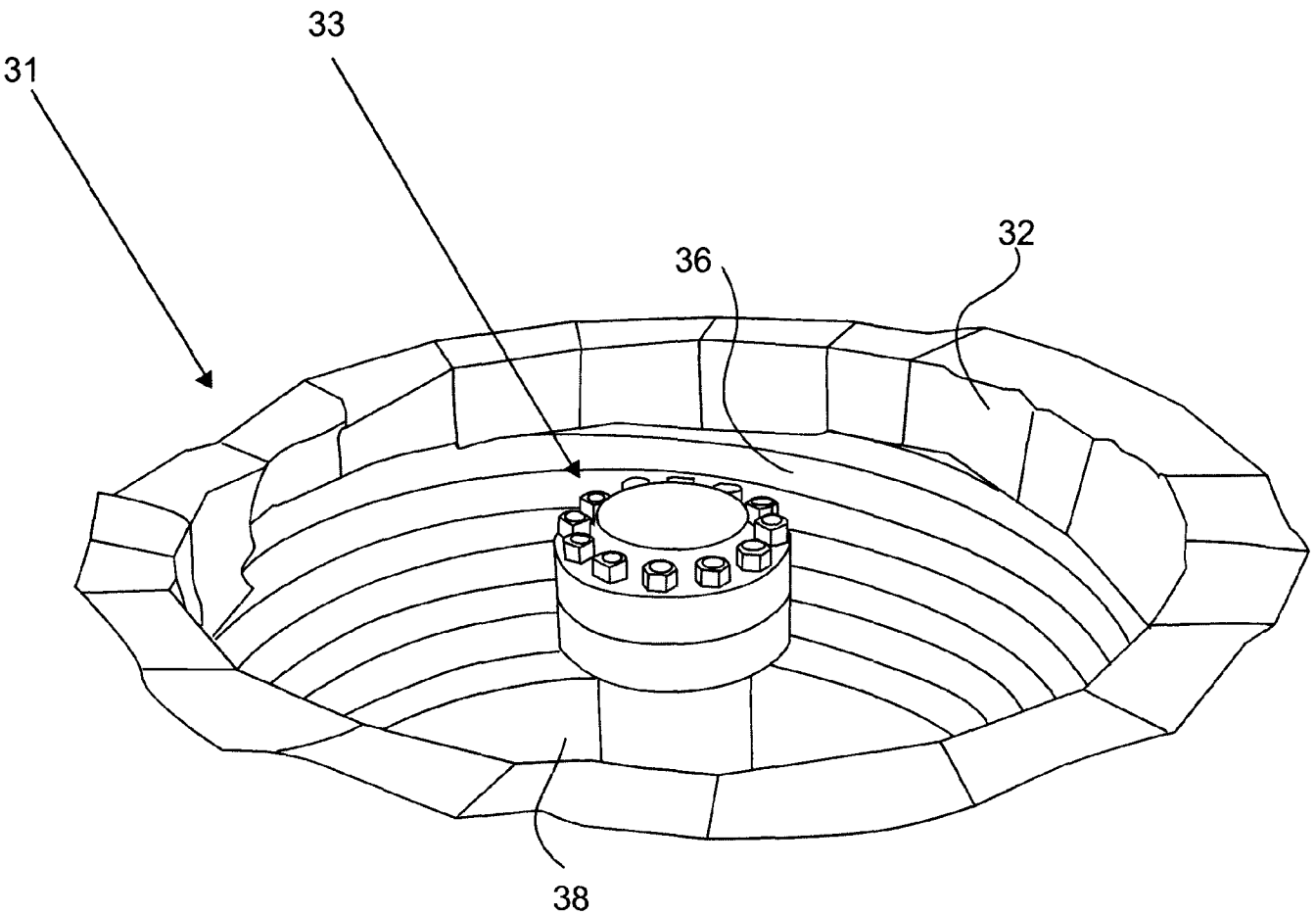
FIG. 5 shows an unsealed well cellar.

In one possible embodiment of the present application as shown in FIG. 5, a well cellar 31 may be contained or sealed by first laying a sheet or layer of containment material 32, comprising a material such as rubber and/or plastic and/or elastic, around and/or over the well cellar 31, as shown in FIG. 5. Also shown in FIG. 5 is a well head 33. The bottom 38 may comprise metal or concrete, and the wall 36 may comprise corrugated metal or may be made for a section of culvert pipe. In one possible embodiment, the section of culvert pipe could be placed in the hole or pit such that the sides of the pit are covered from top to bottom. Concrete could then be poured into the pit, thereby covering the entirety of the bottom of the pit and a lower portion of the culvert pipe. The concrete bottom 38 would then be connected to the side walls in a sealed manner to prevent leaks. Alternatively, the bottom 38 could also be made of metal and connected to the wall 36, such as by welding, in order to prevent or minimize leaks.

Figure 6:
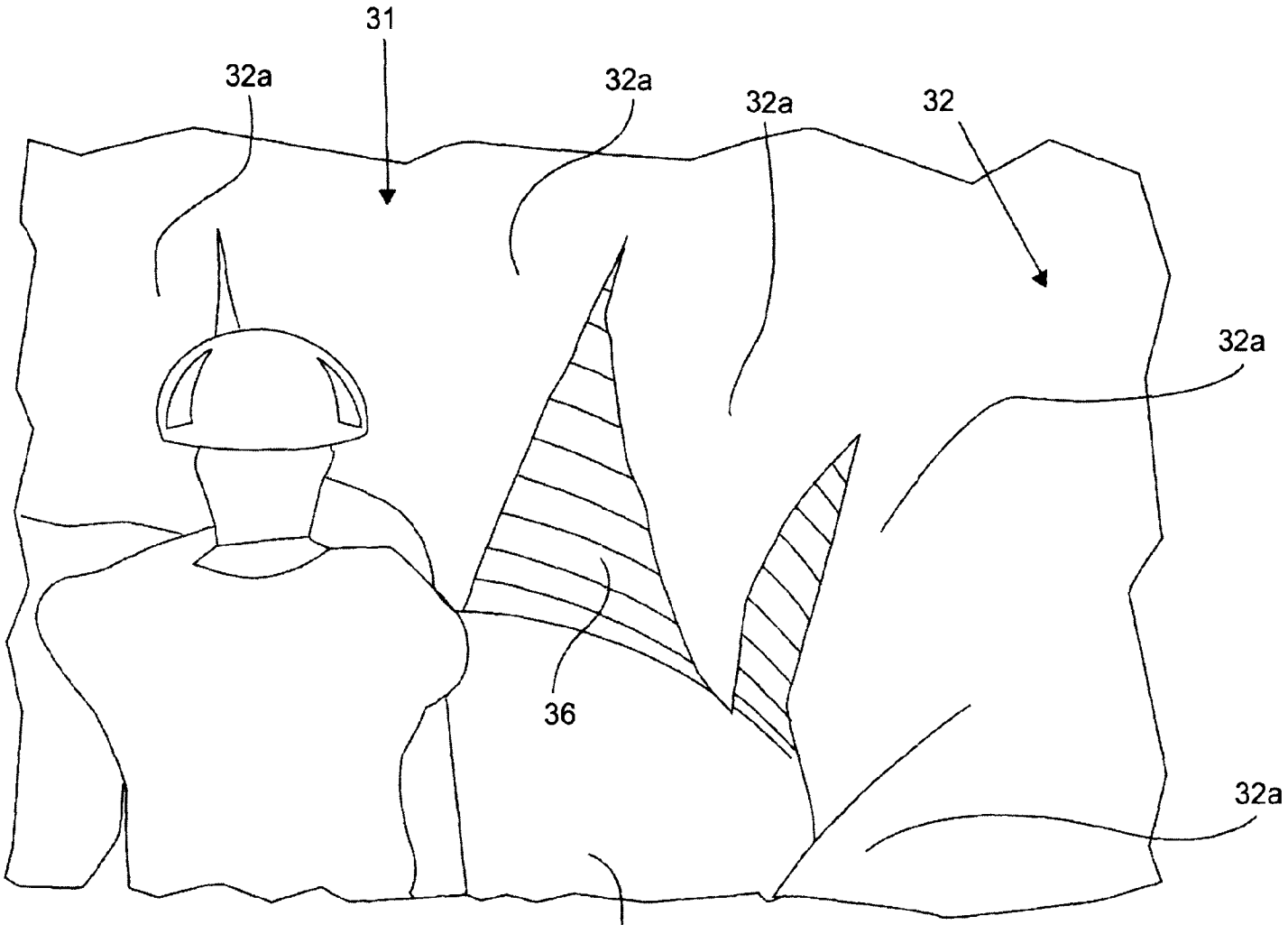
FIG. 6 shows an unsealed well cellar with containment layer disposed thereon.

Once the containment layer 32 is disposed over and/or around the well cellar 31, the containment layer 32 may then be cut with radial cuts to fit the size of the well cellar 31, as shown in FIG. 6. For example, the containment layer may be cut into substantially V-shaped pieces 32*a* or substantially pie piece-shaped flaps 32*a*.

Figure 7:
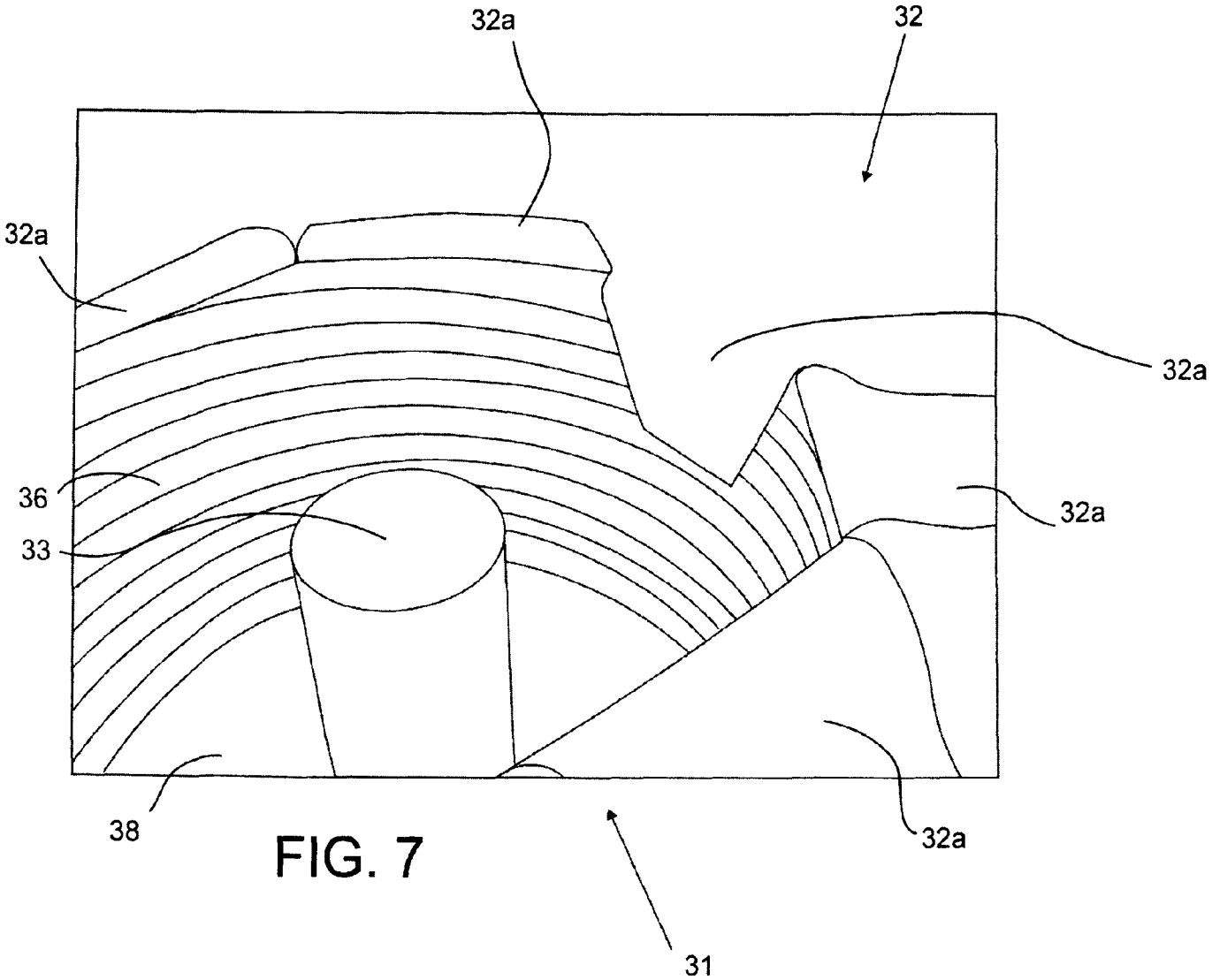
FIG. 7 shows cut containment layer disposed over an unsealed well cellar.
Figure 8:
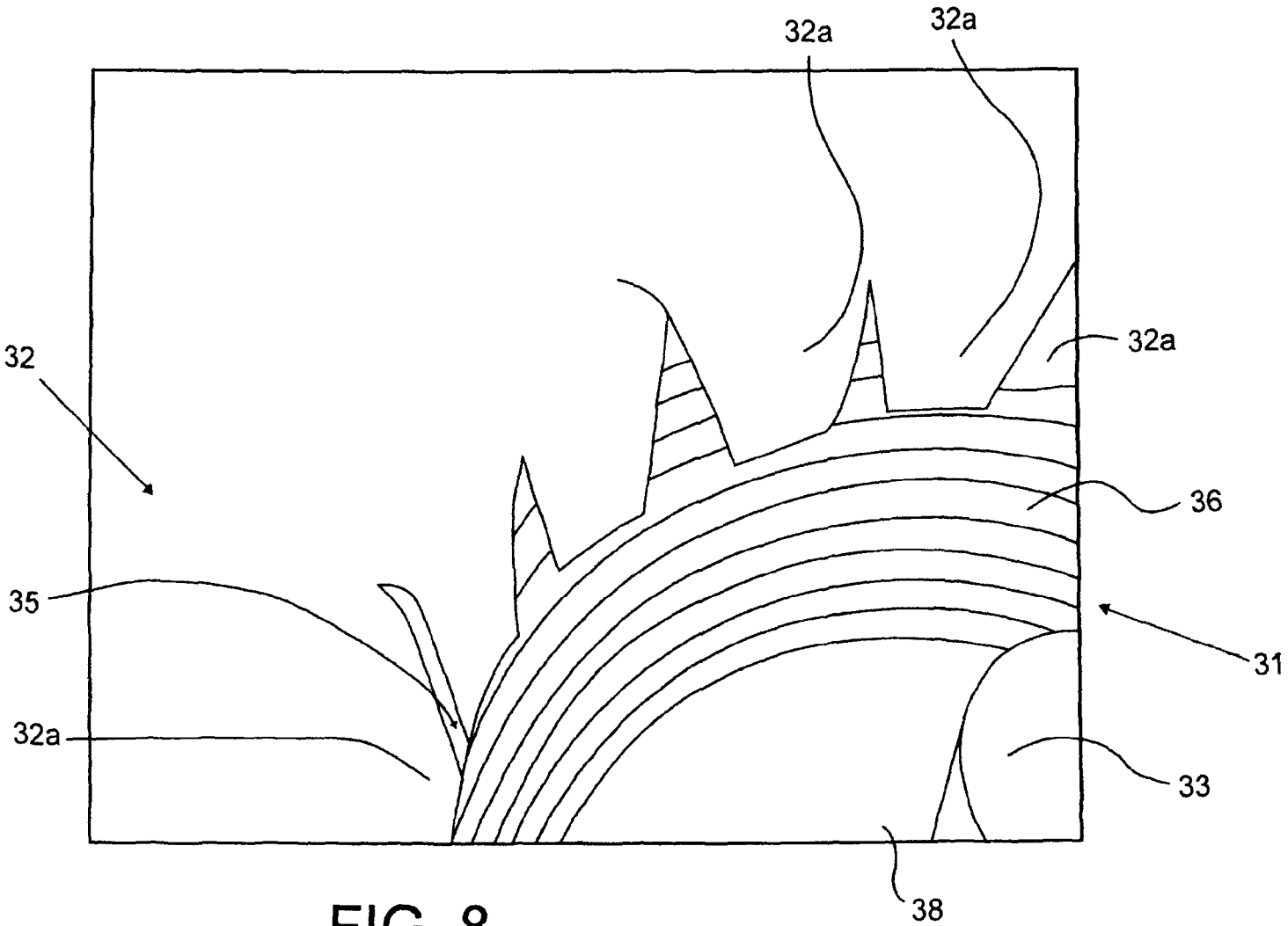
FIG. 8 shows cut containment layer being adhered to a solid member.
Figure 9:
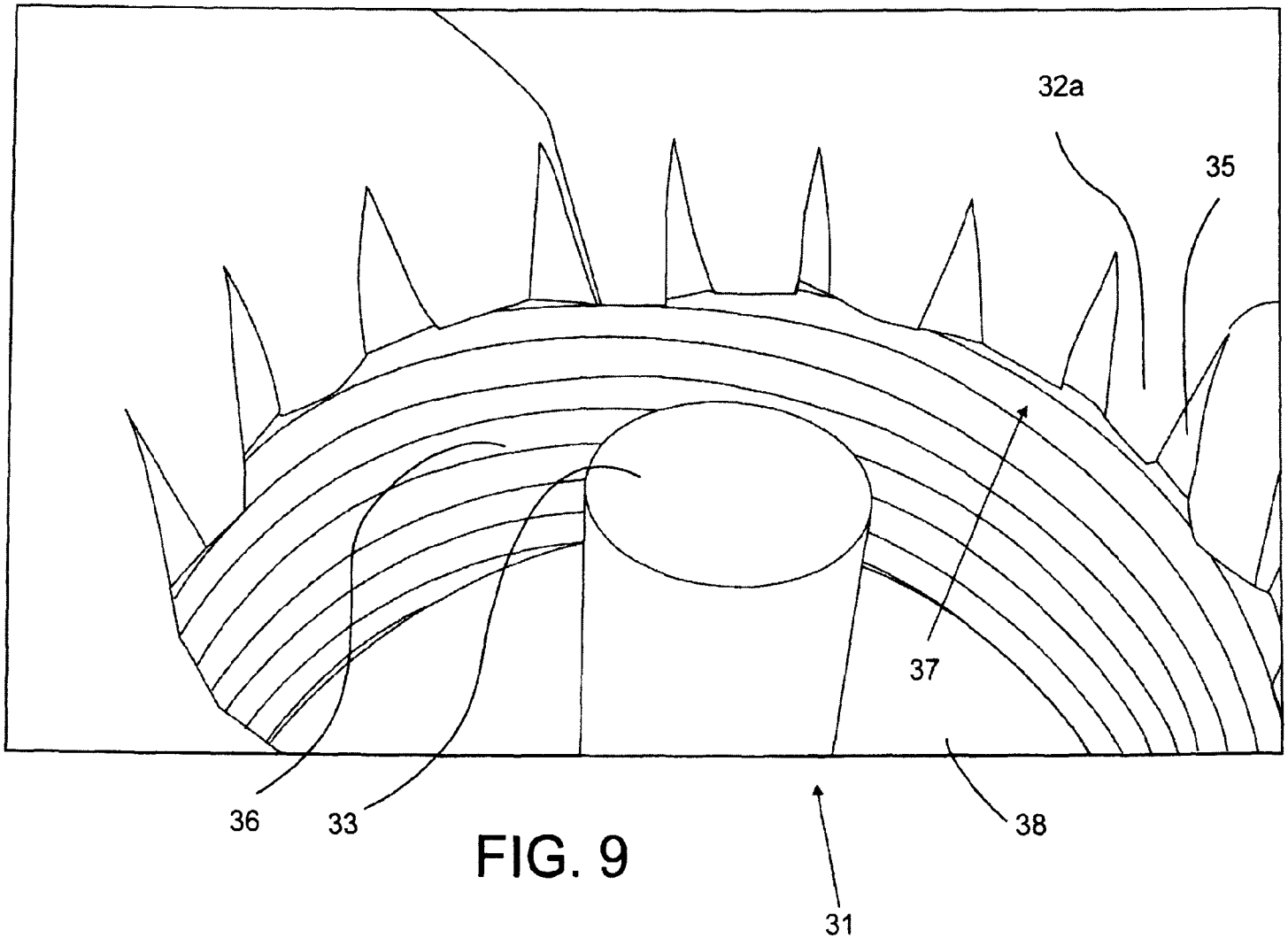
FIG. 9 shows a finished containment layer edge.

Next, the flaps 32*a* may be secured or anchored to a solid member 35, which can be in the form of a membrane. The flaps 32*a* may be folded up and away from the wall 36 so that the solid member 35 may be disposed between the wall 36 and the flaps 32*a*, as shown in FIG. 7. Once the solid member 35 is disposed against the wall 36, the flaps 32*a* may then be flipped back over, so the flaps 32*a* are disposed in the well cellar 31. Then the flaps 23*a* are seamed to make a solid and continuous and/or substantially continuous and leakproof and/or substantially leakproof structure with the sheet 32 by adhering the solid member 35 and the flaps 32*a* together to form a containment layer edge 37, as shown in FIG. 8. A finished containment layer edge 37 is shown in FIG. 9, where the solid member 35 and flaps 32*a* have been cemented, bonded, or otherwise adhered or connected together with, for example, plastic adhesive.

Figure 10:
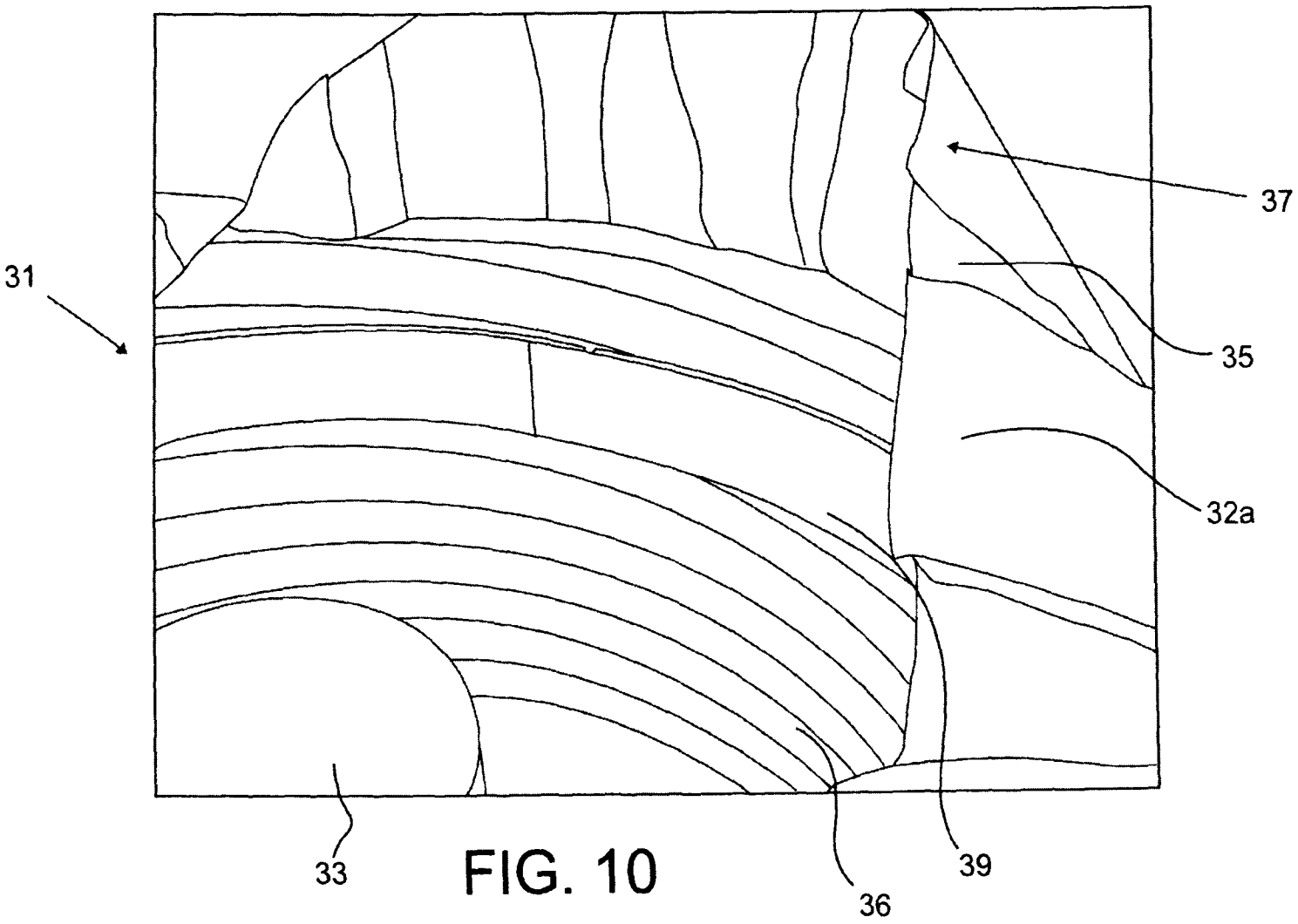
FIG. 10 shows closed cell foam being disposed against a corrugated well cellar wall.

FIG. 10 shows the following step in the process of sealing a well cellar 31. The foam layer 39, which can be a closed cell foam and can be in the shape of a hoop, ring, or circular band, is disposed against the well cellar wall 36 and between the well cellar wall 36 and the containment layer edge 37. In one possible embodiment of the present application, the closed cell foam 39 may provide a seal between the corrugated wall 36 and the containment layer 32. In an alternative embodiment, a seal may be formed by using other materials such as sealants instead of foam to prevent or substantially prevent or minimize leakage from the well cellar 31 into the soil or area around the well cellar 31.

The closed cell foam 39 helps provide a seal to prevent or minimize leakage of fluid under the containment layer 32. As discussed herein, many well cellars 31 are lined with corrugated metal or a section of culvert pipe, which have ridges or undulations and thus present an uneven surface. Consequently, pressing the sealing ring 1 against such an uneven surface may not provide a strong or consistent seal, and thus the opportunity for leakage of fluid may be increased. Since a foam, rubber, elastic, or similar material would have some give and conform to the uneven wall surface, leakage between the foam 39 and the wall of the well cellar 31 could be prevented or minimized. In addition, the foam 39 could also conform to the sealing ring 1, again possibly preventing or minimizing leakage therebetween. Thus, there could be no or very little leakage between the foam 39 and the wall 36, between the foam 39 and the containment layer 32, and between the containment layer 32 and the sealing ring 1.

The foam 39 could also help compensate for manufacturing tolerances. For example, it could be possible to utilize a smooth wall 36 in the well cellar 31, and thus the sealing ring 1 could be pressed against such a wall 36 and clamp the containment layer 34 therebetween. However, since both the wall 36 and the sealing ring 1 would be made of solid, generally inflexible material, such as metal, the shapes and diameters would have to match or follow one another very closely in order to ensure or promote a tight seal about the entirety of the sealing ring 1. If, for example, there is some inconsistency or deformation in a portion of the wall 36, the sealing ring 1 would not engage that portion properly and a gap could be formed in the overall seal. This gap could allow leakage of fluid under the containment layer 32. In contrast, by using a foam layer, band, hoop, or ring 39, such inconsistencies or deformation could be compensated for by the deformability or elasticity of the foam 39. The foam 39 would follow or match the contours of the wall 36 and fill in any gaps which could possibly be formed. However, in at least one possible embodiment the sealing ring 1 could be installed against the wall of the well cellar 31 without the use of a foam layer 39.

In addition, the use of a foam layer 39 would allow for an increase in the pressing force of the sealing ring 1. Again, if the sealing ring 1 were pressed against a solid wall 36, such as one made of metal or concrete, some possible problems could arise. For example, if the metal were less stiff or less resistant to deformation, the expansion of the sealing ring 1 during installation could cause damage to the wall 36, such as by permanent deformation or bending of the metal, which could possibly cause structural problems in the wall 36. On the other hand, if the wall 36 were, for example, made of concrete, it would be very resistant to deformation. The sealing ring 1 then may not seat properly, or could possibly put such stress on the concrete so as to cause cracking. By using a foam layer 39, workers can adjust and expand the sealing ring 1 to form a tight seal essentially without concern for possible negative effects caused by the interaction of the sealing ring 1 and the side wall 36. The foam layer 39 will absorb most of the clamping or sealing forces produced by the expansion of the sealing ring 1, which will allow the formation of a very strong clamping seal. The containment layer 32 will therefore be held very firmly between the sealing ring 1 and the foam layer 39, and thus the chances of any leakage occurring under the containment layer 32 would be eliminated or at least drastically reduced or minimized.

Also, the use of said foam layer 39 and said adjustable sealing ring 1 would allow for installation of said sealing ring 1 in existing well cellars. If the sealing ring 1 were a permanent or integral part of the walls of a well cellar unit, an existing well cellar would have to be modified by removal of the well cellar walls in order to permit installation of the well cellar unit. In contrast, the sealing ring 1 of the present application can be installed in existing well cellars without any need to modify or change the existing well cellars.

Figure 11:
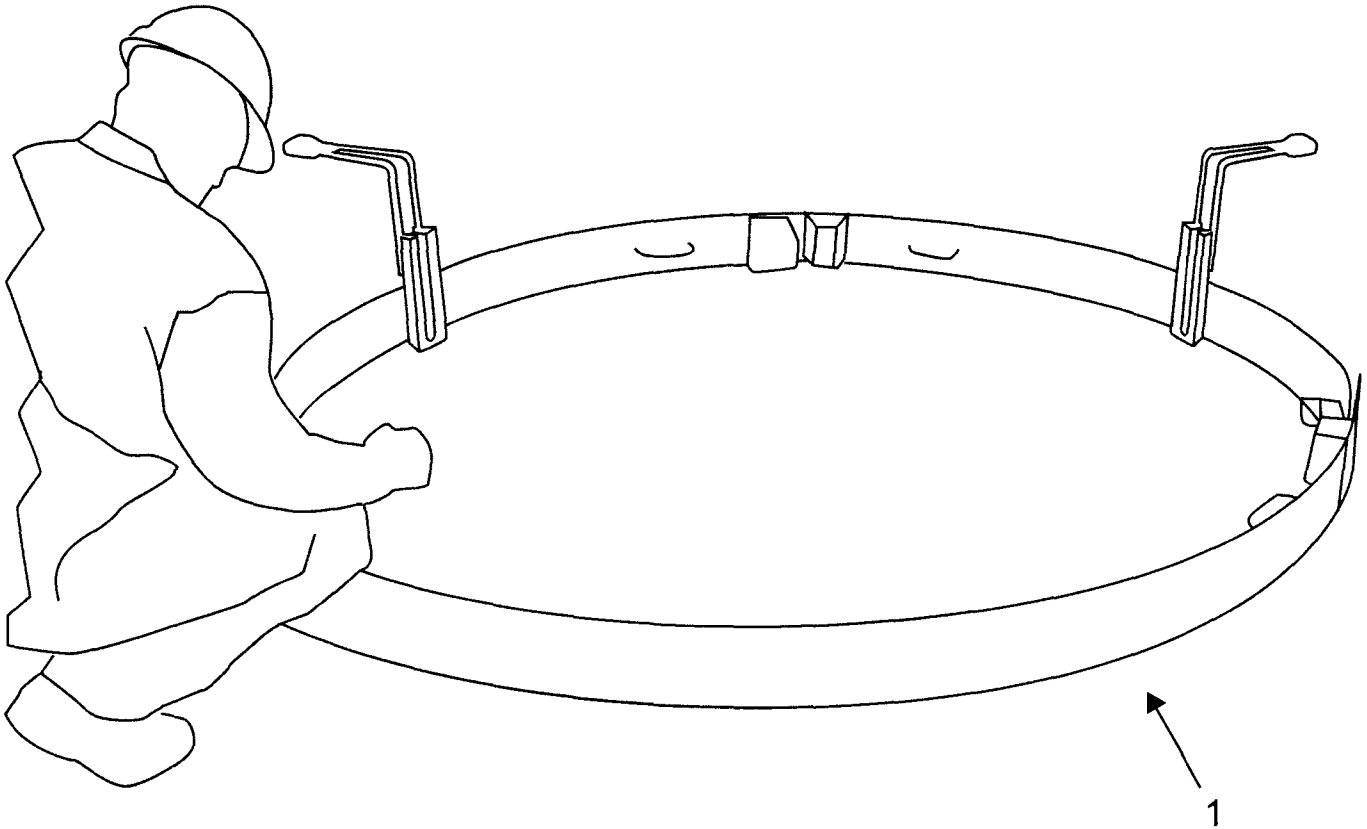
FIG. 11 shows curved elements disposed to form a sealing ring.
Figure 12:
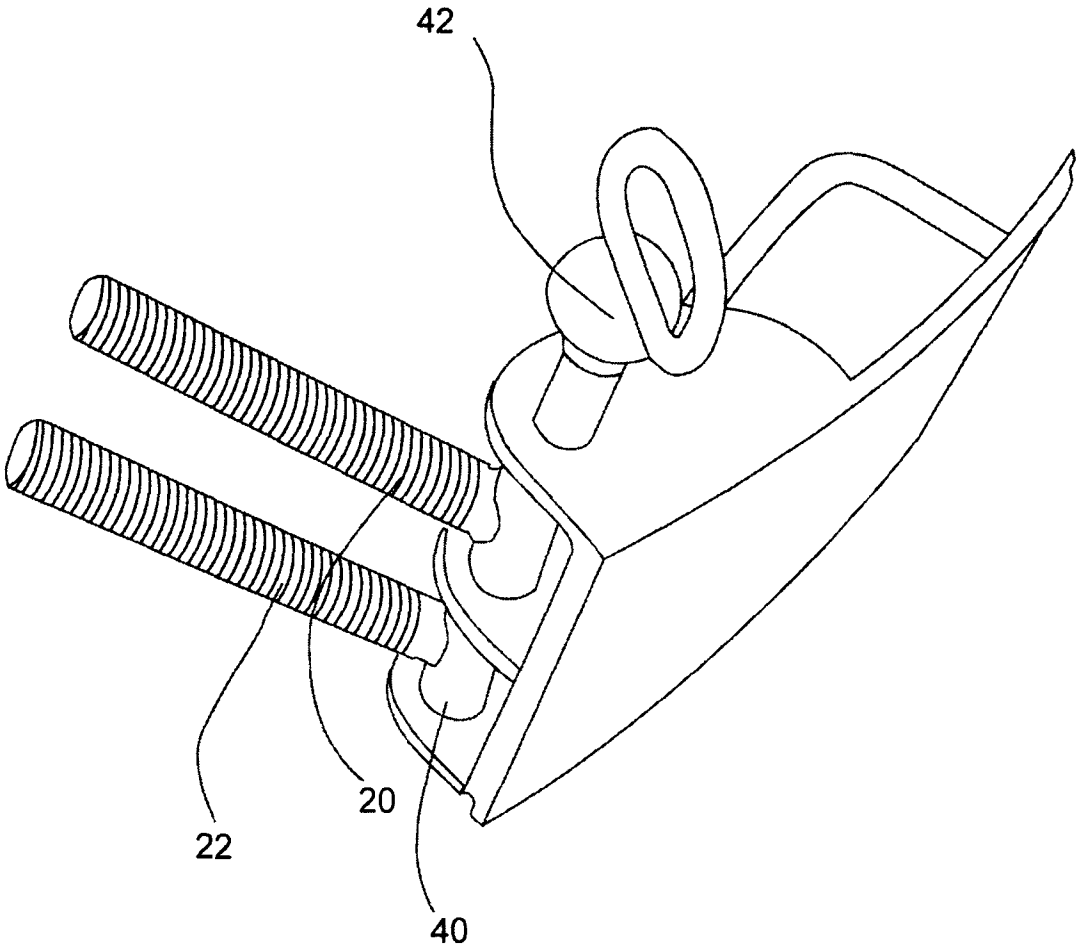
FIG. 12 shows locking bolts and/or threaded spindles being adjusted and/or locked into place.

As shown in FIG. 11, the curved elements 10, 12, and 14 are assembled as a sealing ring 1 with the support elements 16, 17, and 18 attached thereto. Once the foam 39 is in place and the solid member 35 and the flaps 32*a* are disposed in front of the closed cell foam 39, the cellar cap and/or sealing ring 1 is assembled, as previously disclosed in the present application. The locking bolts 20 and 22 and/or threaded spindles 20 and 22 may be adjusted and locked into place, as shown in FIG. 12.

Figure 13:
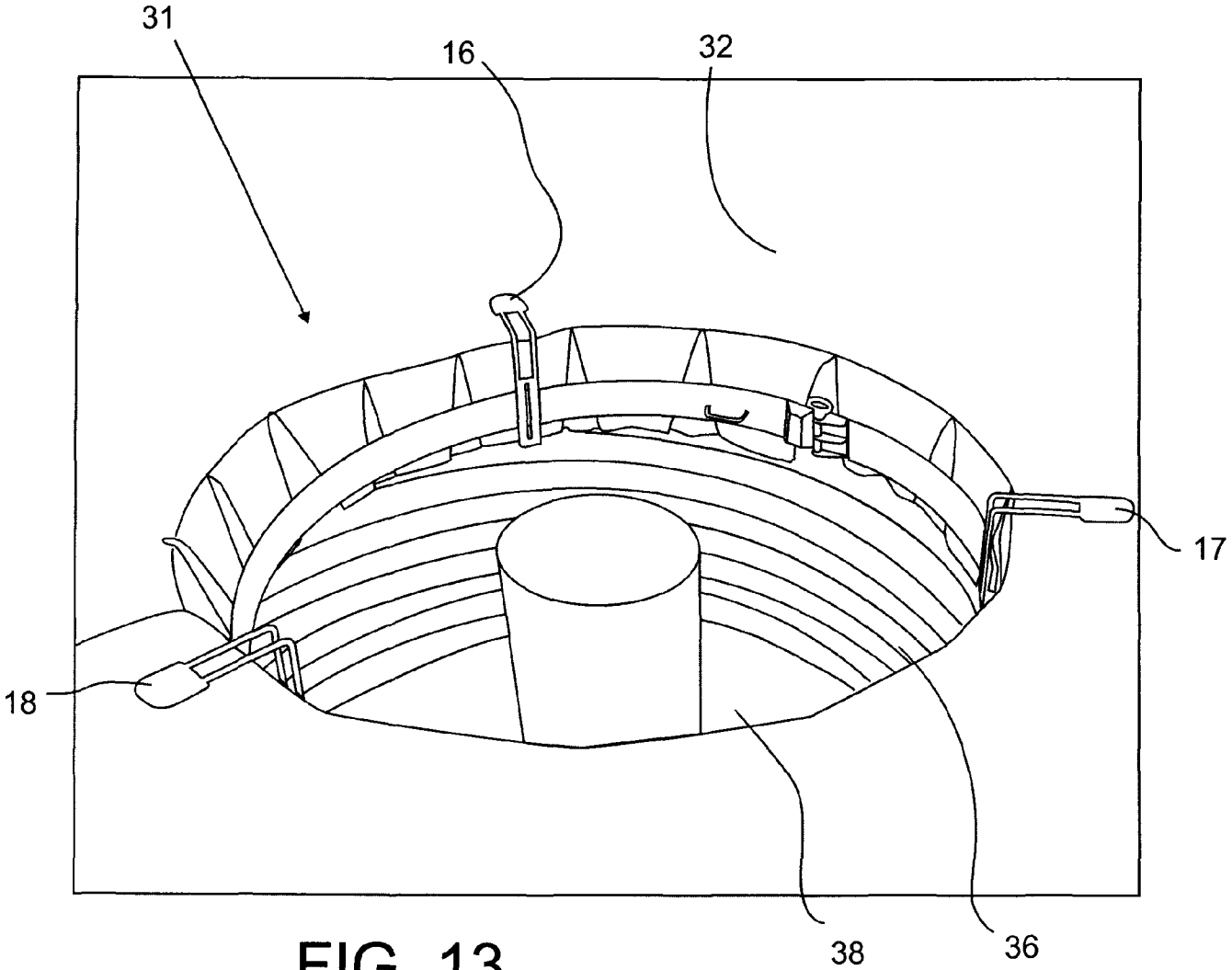
FIG. 13 shows the sealing ring of the present application being suspended and disposed in a well cellar.
Figure 14:
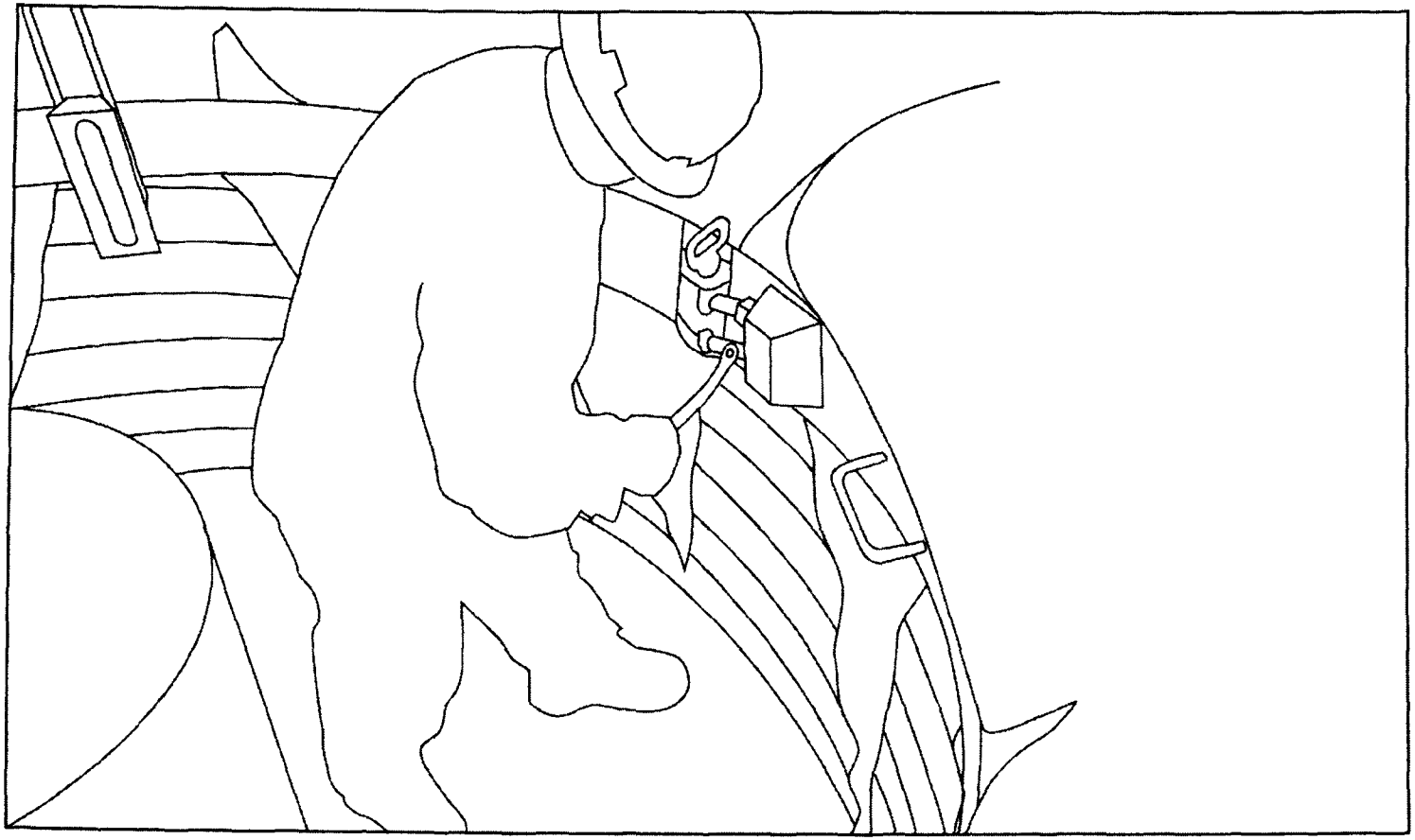
FIG. 14 shows the bolts and/or threaded spindles being tightened to expand the diameter of the sealing ring of the present application and to seal the well cellar.

Next, the cellar cap and/or sealing ring 1, comprising the curved elements 10, 12, and 14, may be installed into the well cellar 31, as shown in FIG. 13. The support elements 16, 17, and 18 may support the sealing ring 1 and/or cellar cap as the sealing ring 1 and/or cellar cap is being installed into the well cellar 31. The support elements 16, 17, and 18 may be removably fastened to the curved elements 10, 12, and 14, for example by screws. The diameter of the sealing ring 1 and/or cellar cap may be expanded and/or adjusted in order to press the containment layer 32 into the wall 36 of the well cellar 31 or against the closed cell foam 39 to thereby hold the containment layer 32 firmly in place against the wall 36 of the well cellar 31 or the closed cell foam 39. The diameter of the sealing ring 1 may be appropriately adjusted by tightening the bolts 20 and 22. The bolts 20 and 22 may be tightened to expand the diameter of the sealing ring 1 and to compress the sealing ring 1 and/or cellar cap into a tight seal or substantially tight seal, as shown in FIG. 14.

Figure 15:
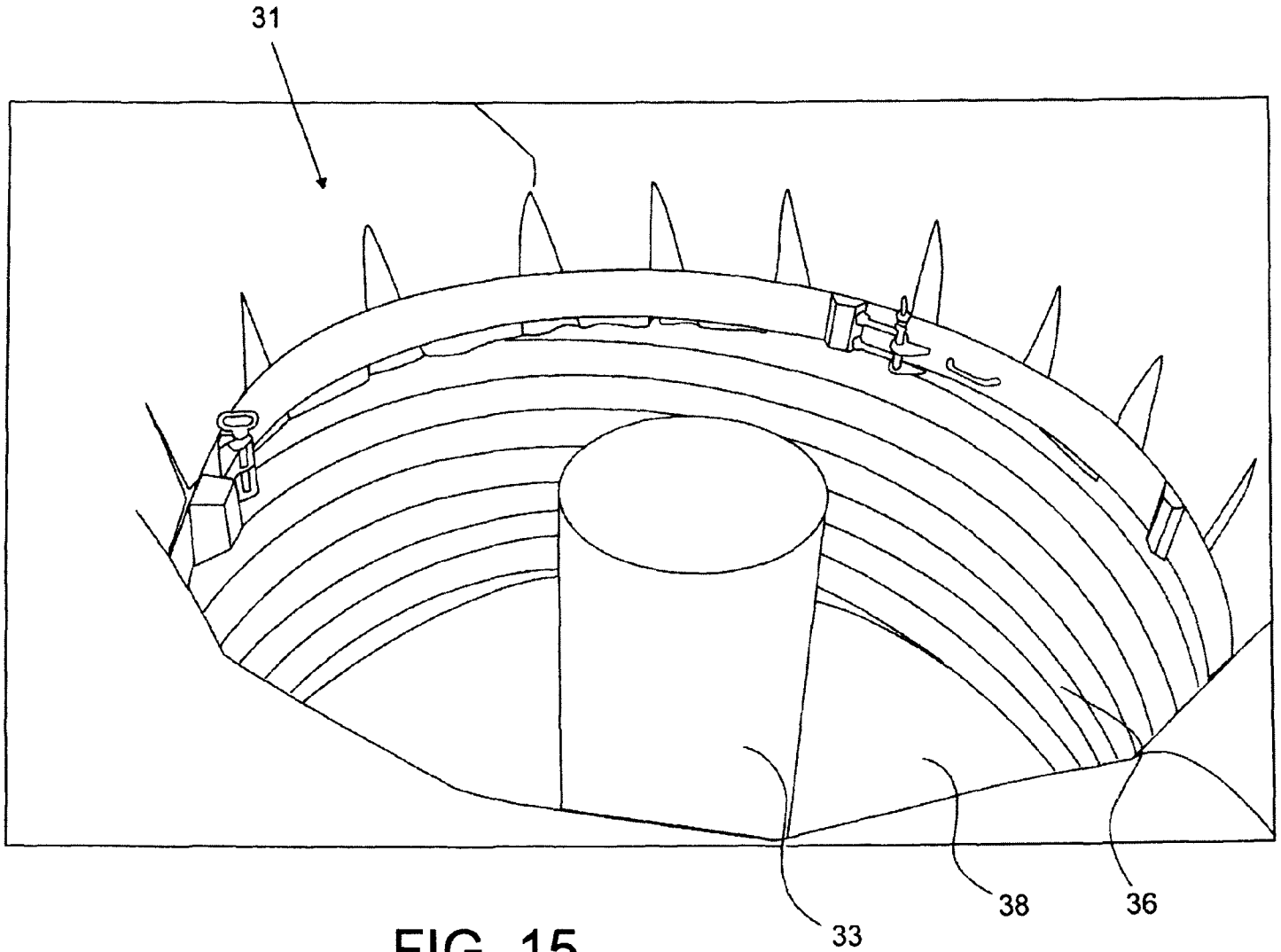
FIG. 15 shows a sealed well cellar, which well cellar is sealed using the sealing ring of the present application.

The support brackets 16, 17, and 18 may then be removed from the sealing ring 1 and/or cellar cap, as shown in FIG. 15. FIG. 15 also shows a tightly sealed or substantially tightly sealed well cellar 31.

Figure 16:
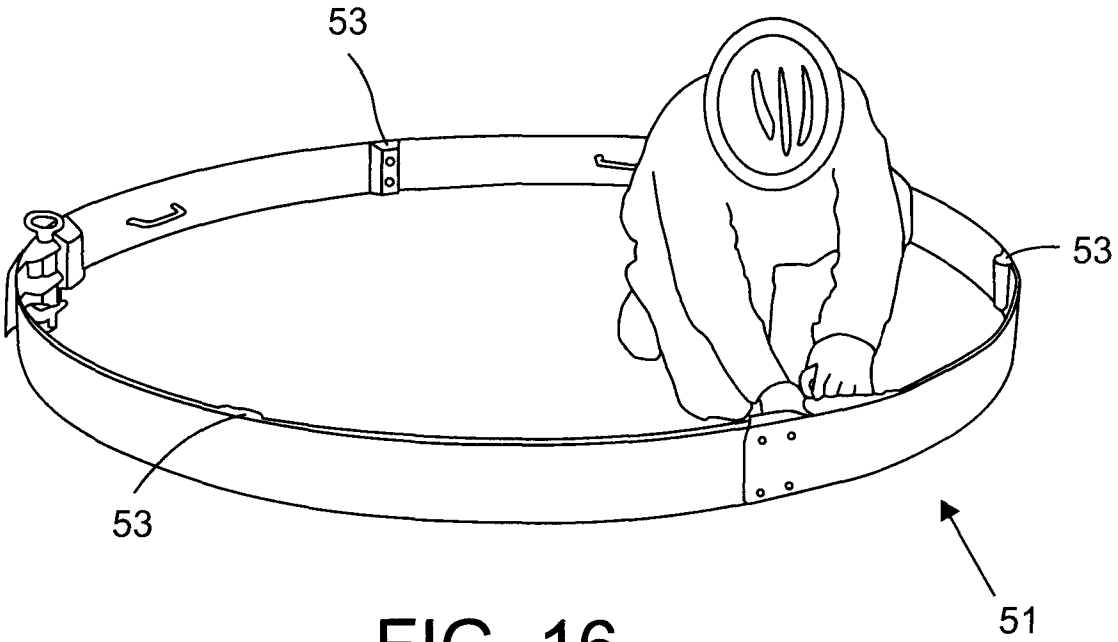
FIG. 16 shows assembly of an embodiment of the sealing ring.

FIG. 16 shows assembly of an embodiment of a sealing ring 51 which has mounting portions 53 for connecting a support structure thereto to support the sealing ring 51. In the embodiment shown, each of the mounting portions 53 has a pair of threaded holes for receiving screws or threaded bolts.

Figure 16A:
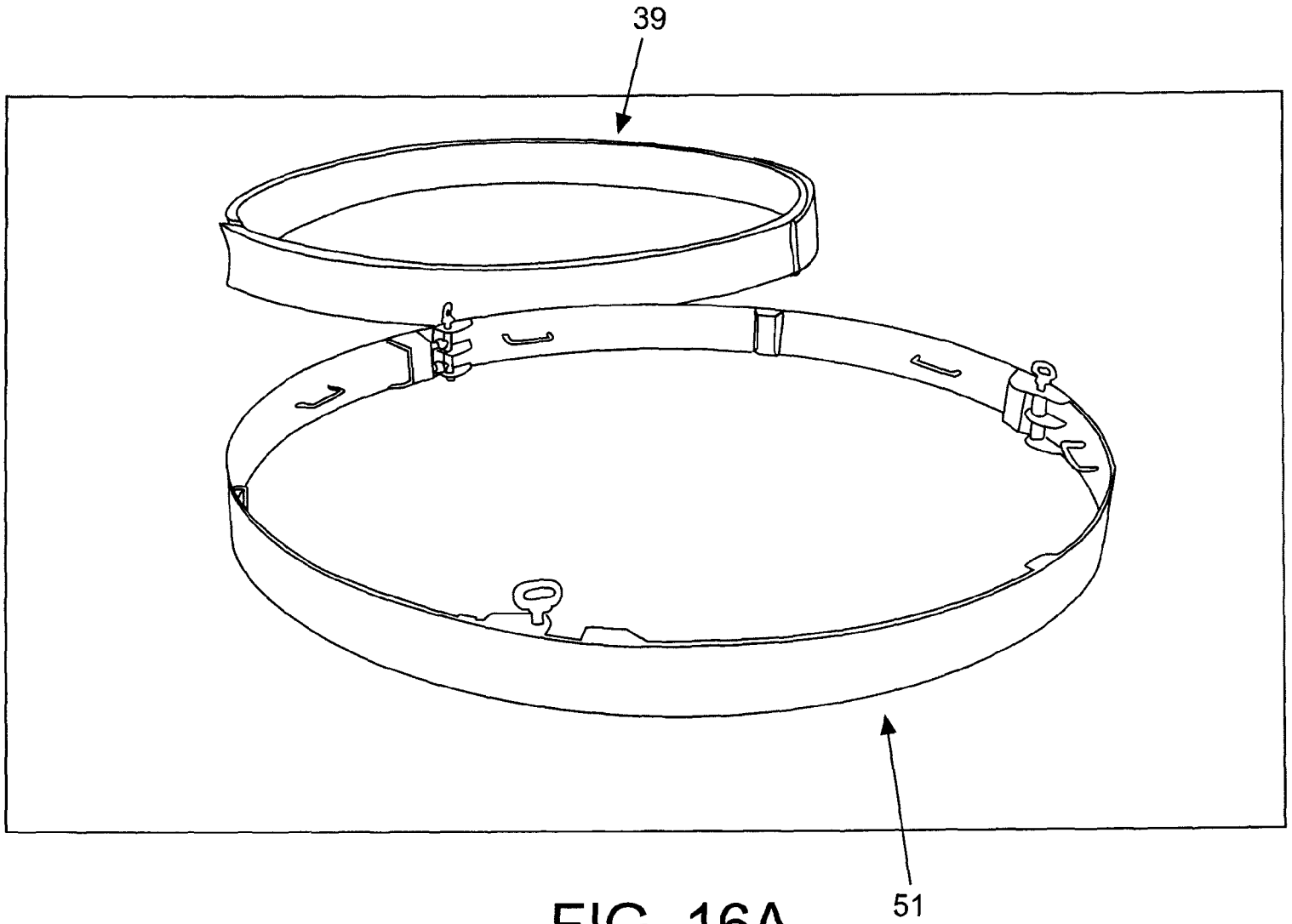
FIG. 16A shows the sealing ring and a corresponding foam ring.

FIG. 16A shows the sealing ring 51 and the foam 39. The foam 39 can be in the shape of a ring to match the sealing ring 51, though other shapes are possible, such as a square or rectangular shape. The foam 39 can be made of a closed cell foam or a resilient material, such as a rubber, elastic, plastic, or other similar material. In at least one possible embodiment, the foam 39 can be a substance that is applied to the side or sides of the well cellar, such as a spray-on foam or similar material.

Figure 17:
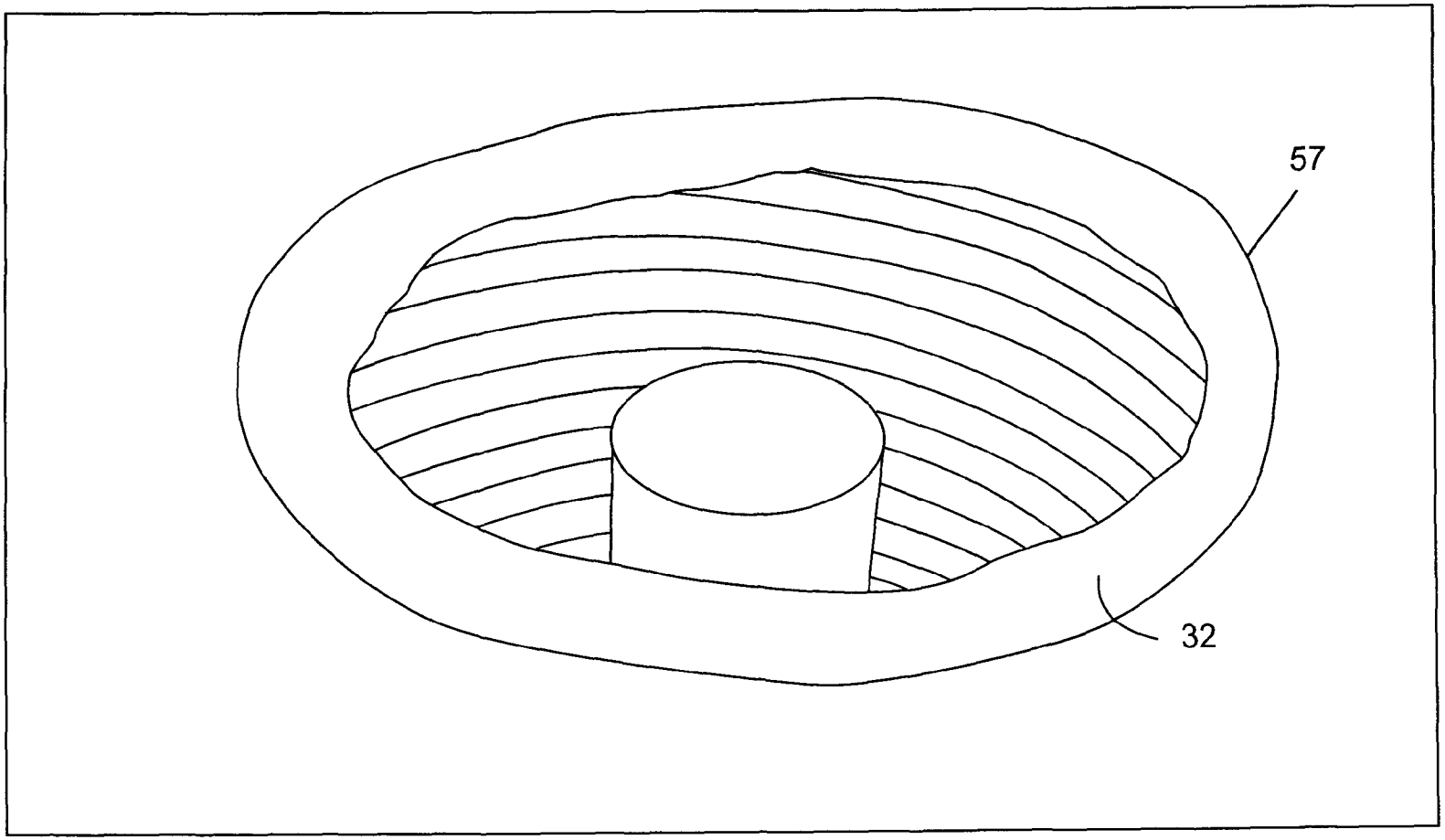
FIG. 17 shows the containment layer prior to cutting.

FIG. 17 shows the containment layer 32 prior to cutting to match the perimeter edge or lip of the well cellar 31. The embodiment shown is the first step in an alternative installation of the containment layer 32 that is different from the installation of the containment layer 32 shown in FIGS. 6-10. A rough opening is initially cut in the containment layer 32, and then the perimeter edge of the well cellar 31 is marked off with a circular line 57, which line 57 serves as a guide for trimming or cutting off the excess portion of the containment layer 32. The opening that is cut in the containment layer 32 should substantially match or follow the perimeter edge or lip 34 of the well cellar 31.

Figure 18:
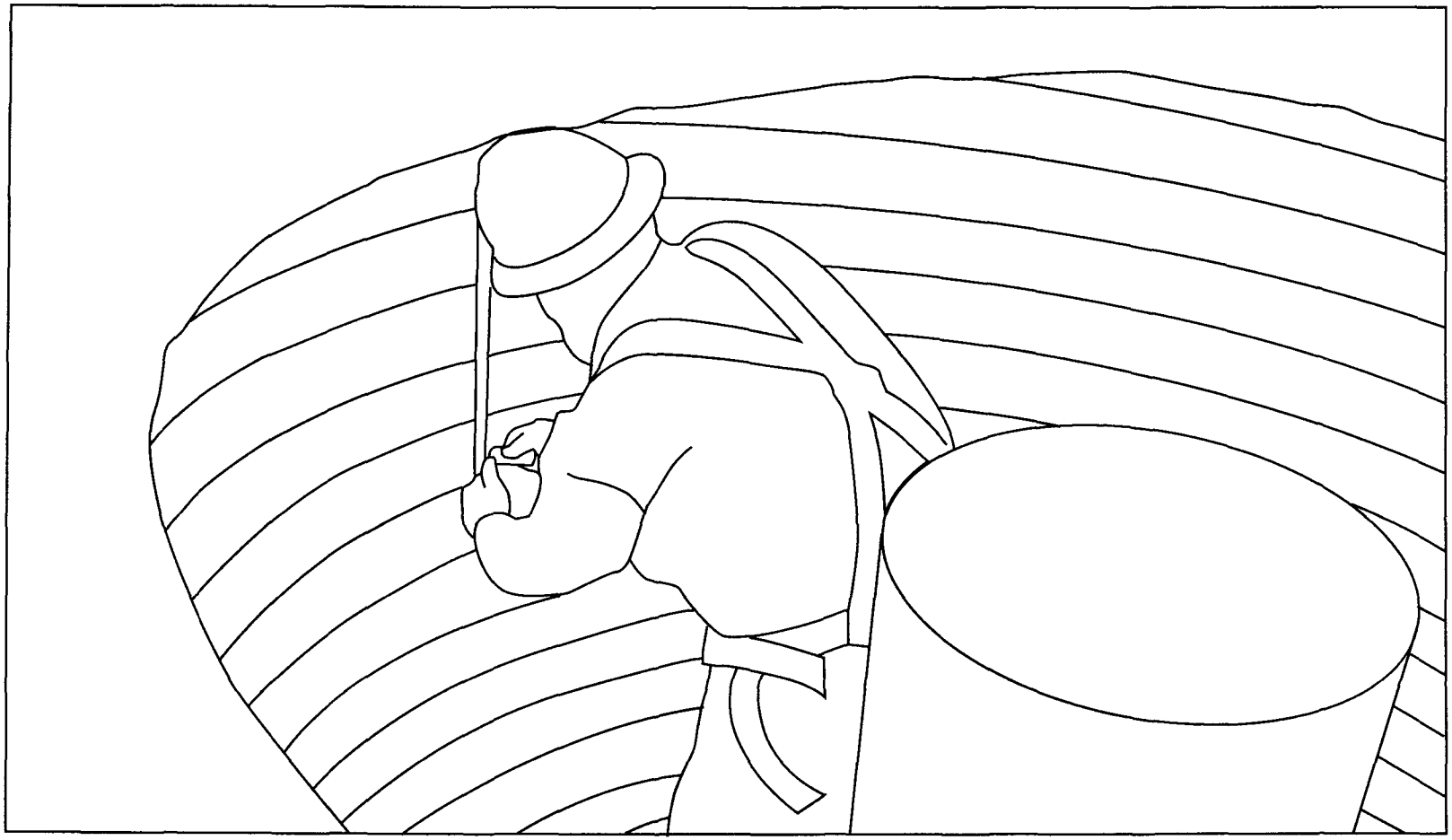
FIG. 18 shows workers setting the height of the foam.
Figure 19:
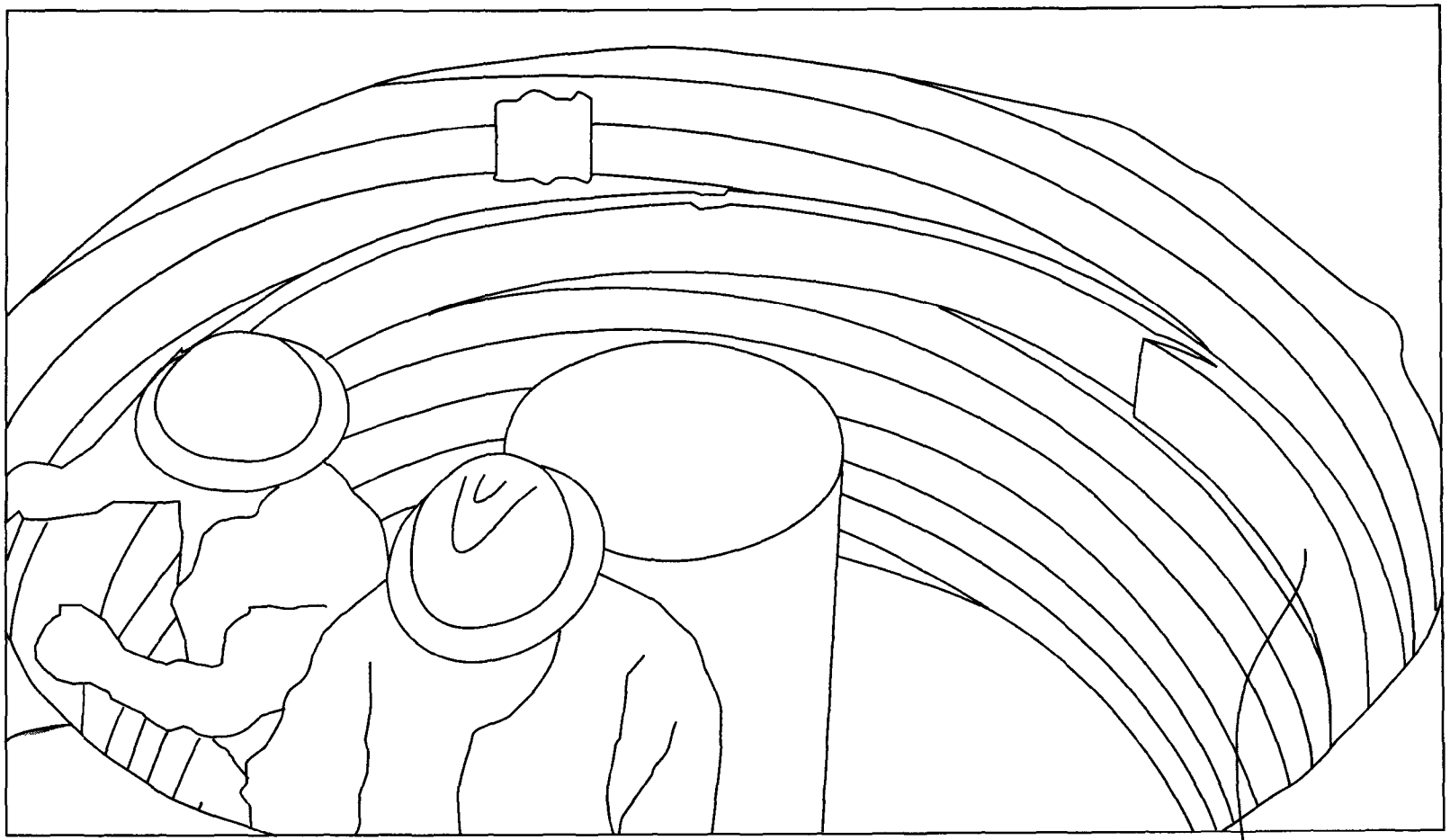
FIG. 19 shows workers installing the foam.

Once the containment layer 32 has been cut to match or substantially match the edge 34 of the well cellar 31, workers then take measurements to determine where the closed cell foam 39 is to be placed inside the well cellar 31, as shown in FIG. 18. The workers then install the closed cell foam 39, which can be in the shape of a ring, inside the well cellar 31 against the interior side wall, as shown in FIG. 19.

Figure 20:
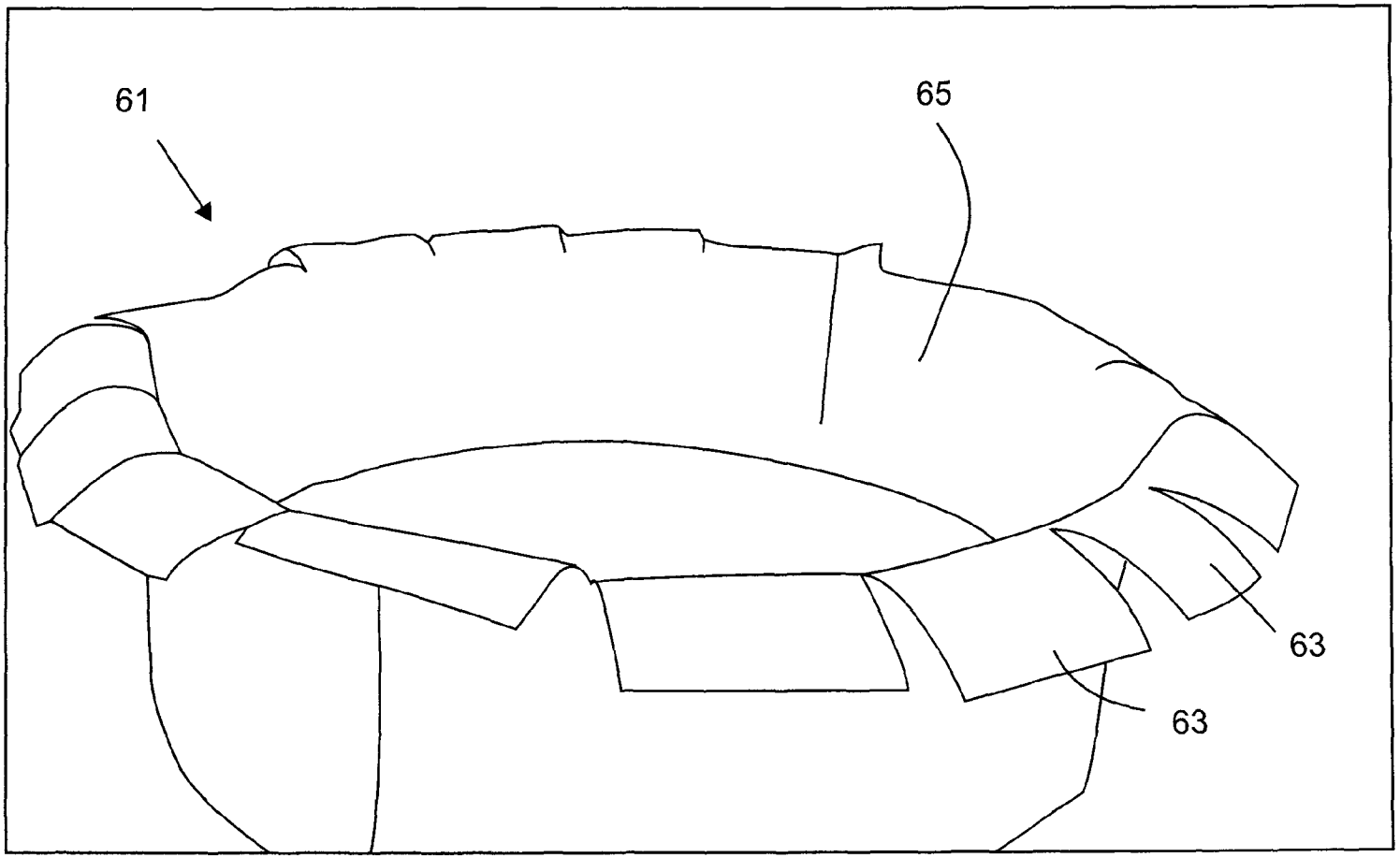
FIG. 20 shows a containment skirt.

FIG. 20 shows a containment skirt 61. The containment skirt 61 is made of the same or similar material as the containment layer 32. The containment skirt 61 is shaped as a cylinder of approximately the same diameter as the well cellar 31, but slightly less so that the containment skirt 61 can be placed inside the well cellar 31. Slits or notches are cut into a first or upper portion of the containment skirt 61 to form flaps 63, which are bent or folded outwardly. A second or lower portion 65 of the containment skirt 61 is not cut and thus maintains its cylindrical or tubular shape.

Figure 21:
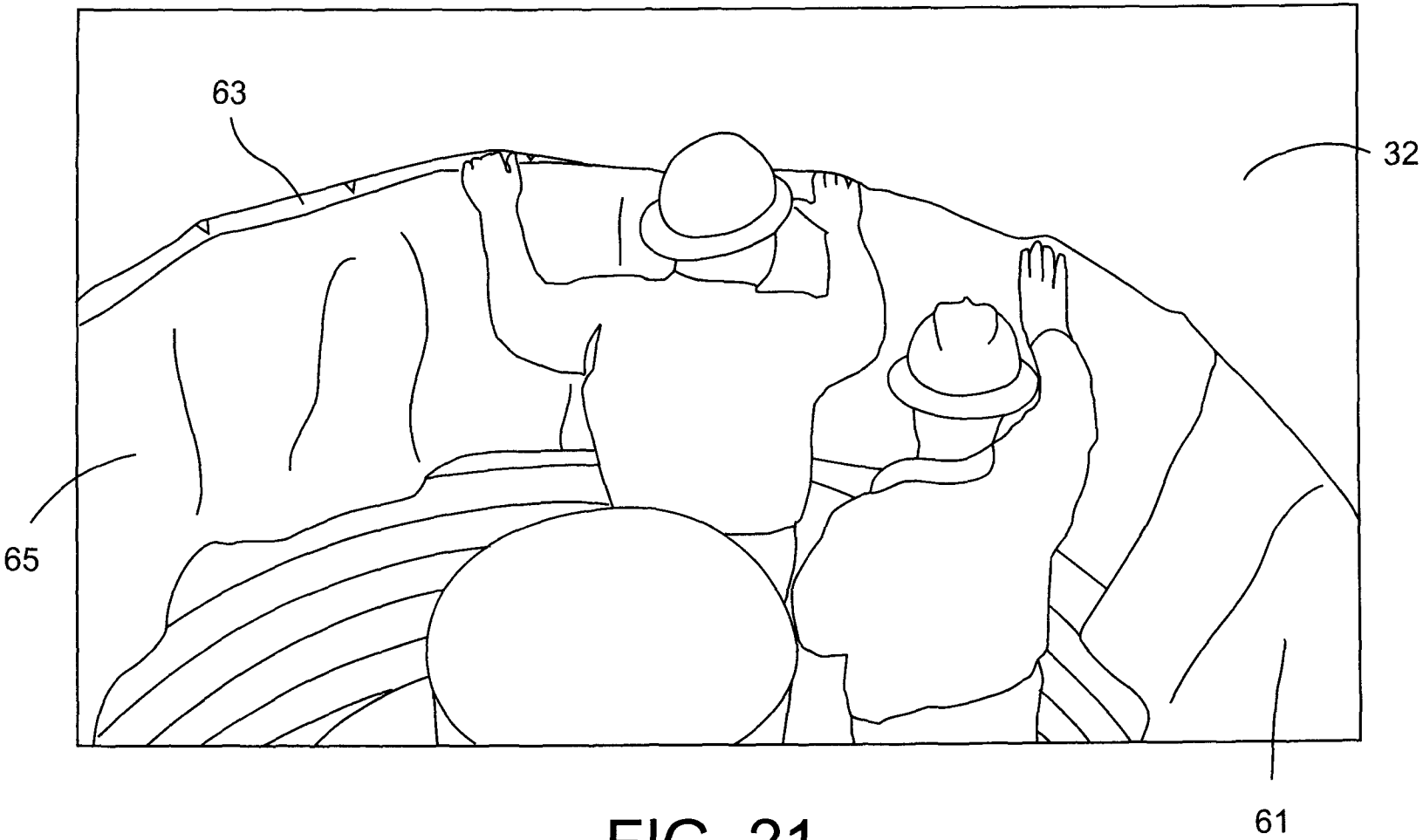
FIG. 21 shows installation of the containment skirt.
Figure 22:
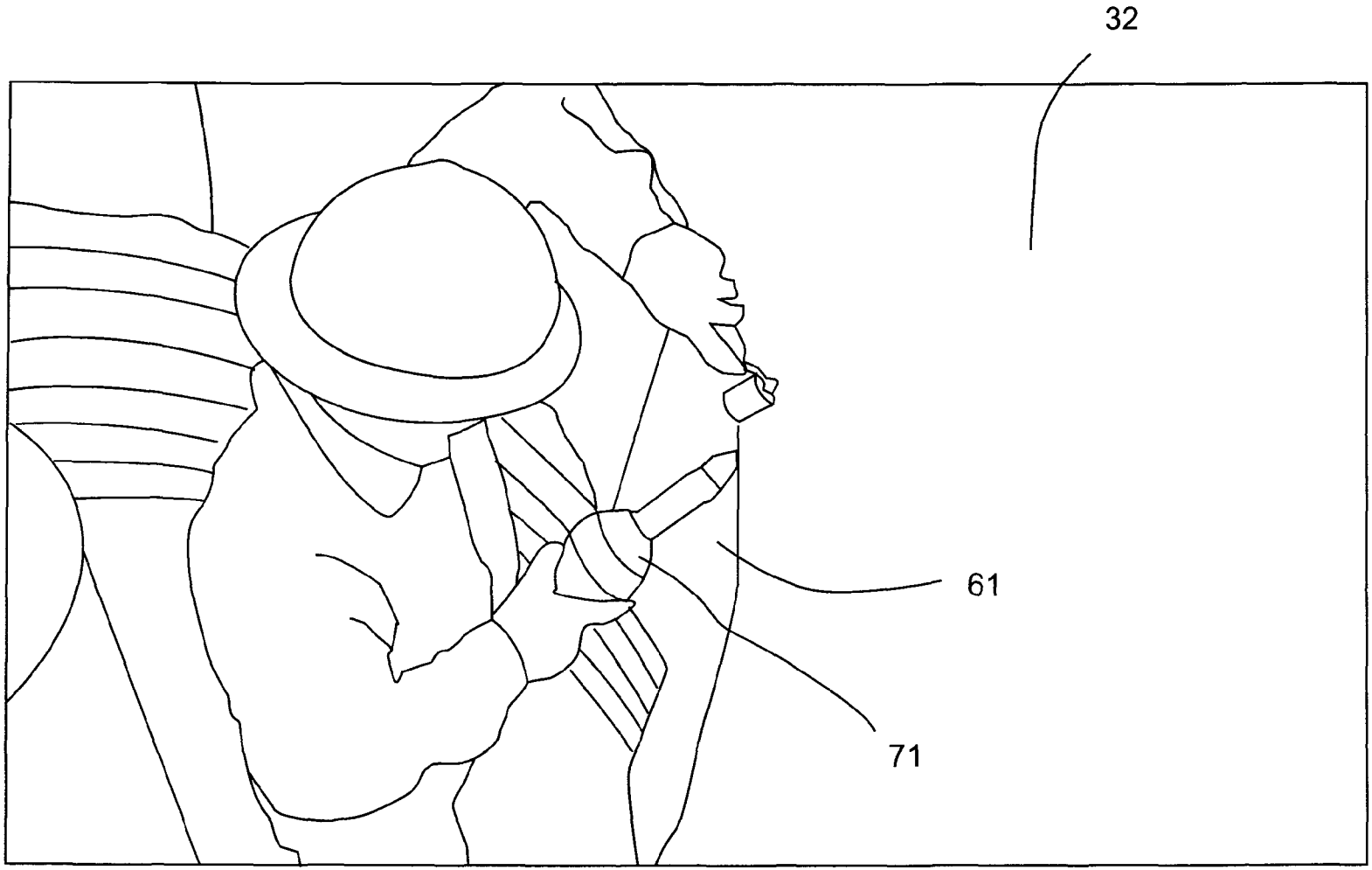
FIG. 22 shows a worker sealing the containment skirt to the containment layer.

FIG. 21 shows installation of the containment skirt 61. The flaps 63 are slid or tucked under the containment layer 32, whereas the second, cylindrical portion 65 hangs loosely and generally follows the interior wall of the well cellar 31. FIG. 22 shows a worker sealing, joining, or connecting the containment skirt 61 to the containment layer 32. A connecting tool 71, such as a heat sealing tool or other appropriate tool, can be used to connect or bond or join the edge of the containment layer 32 to the skirt 61 so that the containment skirt 61 acts as an extension of the containment layer 32. In other words, the containment layer 32 and the containment skirt 61 together form a single containment structure that extends seamlessly, essentially seamlessly, or substantially seamlessly over the perimeter edge 34 of the well cellar 31 and into the interior of the well cellar 31. Such a containment structure serves to prevent or minimize the entry of drilling or well contaminants into the surrounding land.

Figure 23:
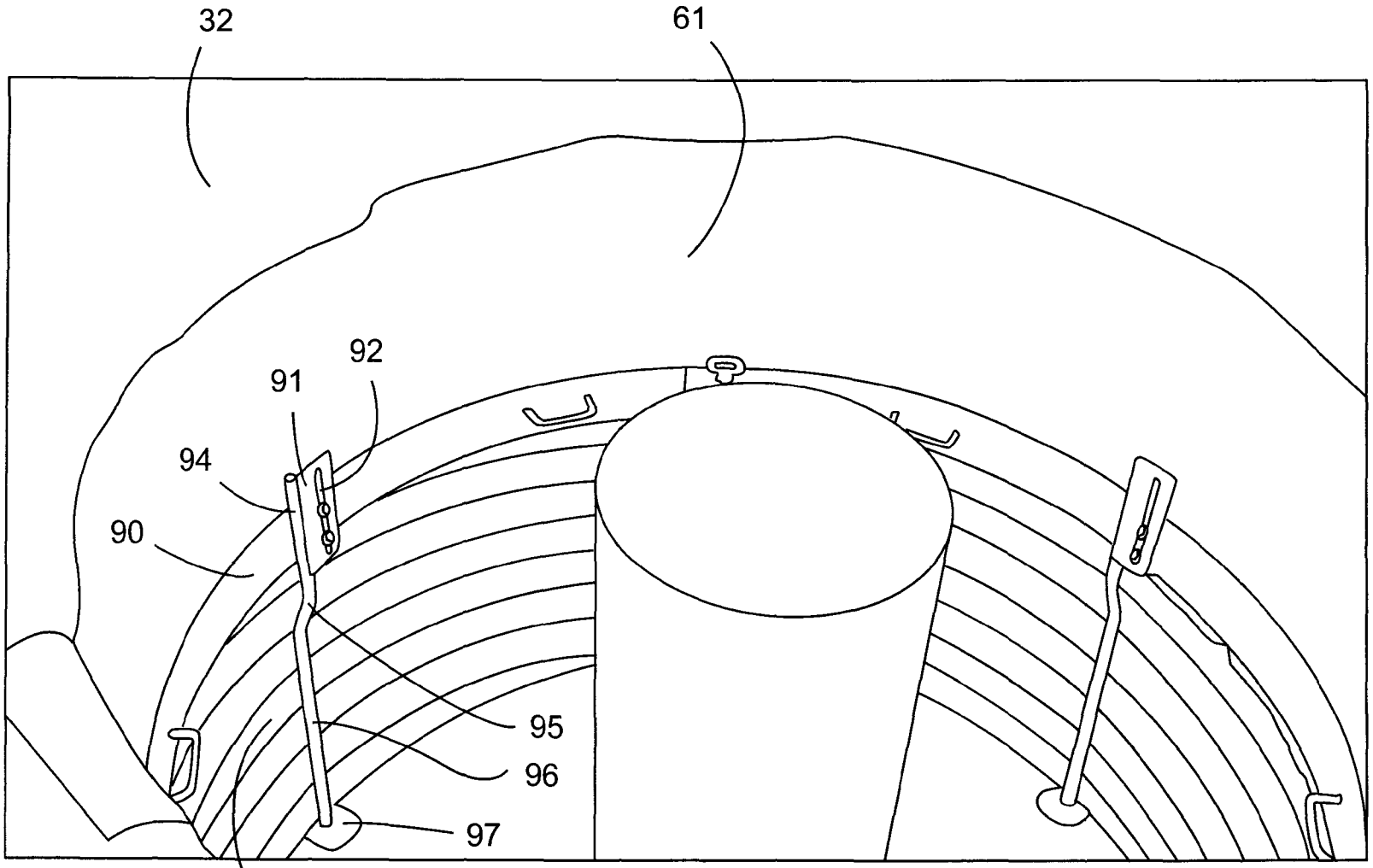
FIG. 23 shows an installed sealing ring with additional support structures.

FIG. 23 shows an installed sealing ring 51 with support structures 90. Each of the support structures 90 has a connecting flange 91 with a slot 92 formed or cut therein. Screws, threaded bolts, or other similar structures are inserted through the slot 92 and into corresponding threaded holes in the mounting portion 53 of the sealing ring 51. The connecting flange 91 is joined or connected to a leg structure 93. The leg structure 93 is made up of a first, substantially straight portion 94 to which the connecting flange 91 is connected, a second, substantially S-shaped portion 95, a third, substantially straight portion 96, and a foot portion 97. The leg structures 93 provide additional support for the sealing ring 51. Alternatively, as discussed previously, the sealing ring 1 can be supported from above by support elements 16. In another possible embodiment, the sealing ring 1, 51 can be supported solely by the clamping or pressing force of the sealing ring 1, 51 toward the interior wall of the well cellar 31.

One feature or aspect of an embodiment is believed at the time of the filing of this patent application to possibly reside broadly in a method of minimizing leakage of oil and/or drilling mud into the soil about an oil well and/or a gas well, said method comprising the steps of: digging a well cellar for a gas or oil well; lining said well cellar with a liner and extending the liner to at least the uppermost portion of said well cellar; installing a kit comprising: at least three arcuate members configured to hold said liner within said well cellar; each said arcuate member comprising at least two threaded studs with nuts disposed on a first end of each said arcuate member; each said arcuate member comprising at least two holes disposed on a second end of each said arcuate member opposite said first end of each said arcuate member; each said arcuate member comprising at least one support element configured to support each said arcuate member from the level of the soil disposed about said well cellar; said method further comprising the steps of: disposing said at least three arcuate members about said well cellar; suspending each of said arcuate members from its at least one support element; pressing said arcuate members against said well cellar wall; inserting said threaded studs, from a first arcuate member, into said holes in said second arcuate member; inserting said threaded studs, from a second arcuate member, into said holes in said third arcuate member; inserting said threaded studs, from said third arcuate member, into said holes in said first arcuate member; adjusting said nuts on said threaded studs and tightening said arcuate members against said liner and pressing said liner against said wall of said well cellar until said liner is firmly and permanently pressed against said wall of said well cellar thereby minimizing slippage of said liner in said well cellar; disposing a drilling rig above said well cellar and commencing drilling for oil and/or gas; collecting drilling mud and/or oil from said drilling in said well cellar and preventing or minimizing drilling mud and/or oil from contaminating soil about said well cellar; and removing said drilling mud and/or said oil from said well cellar upon and excessive accumulation of drilling mud and/or oil in said well cellar and preventing or minimizing drilling mud and/or oil from contaminating soil about said well cellar.

Another feature or aspect of an embodiment is believed at the time of the filing of this patent application to possibly reside broadly in a method of minimizing leakage of oil and/or drilling mud into the soil about an oil well and/or a gas well, said method comprising the steps of: digging a well cellar for a gas or oil well; lining said well cellar with a liner and extending the liner to at least the uppermost portion of said well cellar; installing a kit comprising: at least three arcuate members configured to hold said liner within said well cellar; each said arcuate member comprising at least two threaded studs with nuts disposed on a first end of each said arcuate member; each said arcuate member comprising at least two unthreaded holes disposed on a second end of each said arcuate member opposite said first end of each said arcuate member; each said arcuate member comprising at least one support element configured to support each said arcuate member from the level of the soil disposed about said well cellar; said method further comprising the steps of: disposing said at least three arcuate members about said well cellar; suspending each of said arcuate members from its at least one support element; pressing said arcuate members against said well cellar wall; inserting said threaded studs, from a first arcuate member, into said unthreaded holes in said second arcuate member; inserting said threaded studs, from a second arcuate member, into said unthreaded holes in said third arcuate member; inserting said threaded studs, from said third arcuate member, into said unthreaded holes in said first arcuate member; adjusting said nuts on said threaded studs and tightening said arcuate members against said liner and pressing said liner against said wall of said well cellar until said liner is firmly and permanently pressed against said wall of said well cellar thereby minimizing slippage of said liner in said well cellar; disposing a drilling rig above said well cellar and commencing drilling for oil and/or gas; collecting drilling mud and/or oil from said drilling in said well cellar and preventing or minimizing drilling mud and/or oil from contaminating soil about said well cellar; and removing said drilling mud and/or said oil from said well cellar upon and excessive accumulation of drilling mud and/or oil in said well cellar and preventing or minimizing drilling mud and/or oil from contaminating soil about said well cellar.

Yet another feature or aspect of an embodiment is believed at the time of the filing of this patent application to possibly reside broadly in a method of drilling a gas well while minimizing leakage of oil and/or drilling mud into the soil about a gas well, said method comprising the steps of: determining a location for the drilling of a gas well; digging a well cellar at said location for a gas well with substantially vertical walls and a substantially flat floor; lining said well cellar with a liner and extending the liner about the soil around the well cellar a substantial distance from the wall of said well cellar at least at the uppermost portion of said well cellar and minimizing leakage of oil and/or drilling mud into the soil about the gas will; installing said lining with a kit comprising: at least three arcuate members configured to hold said liner within said well cellar; each said arcuate member comprising at least two threaded studs and nuts configured to be disposed on a first end of each said arcuate member; each said arcuate member comprising at least two holes disposed on a second end of each said arcuate member opposite said first end of each said arcuate member; each said arcuate member comprising at least one support element configured to support each said arcuate member from the level of the soil disposed about said well cellar; said method further comprising the steps of: threading said nuts onto said threaded studs on each of said arcuate members; disposing said at least three arcuate members about said well cellar; suspending each of said arcuate members from its at least one support element; pressing said arcuate members against said well cellar wall; inserting said threaded studs, from a first arcuate member, into said holes in said second arcuate member; inserting said threaded studs, from a second arcuate member, into said holes in said third arcuate member; inserting said threaded studs, from said third arcuate member, into said holes in said first arcuate member; adjusting said nuts on said threaded studs by moving said nuts on said threaded studs and tightening said arcuate members against said liner and pressing said liner against said wall of said well cellar until said liner is firmly and permanently pressed against said wall of said well cellar thereby minimizing slippage of said liner in said well cellar; forming at an opening at the bottom of said liner and pushing a conductor pipe into and through said opening and into the soil below the bottom of said liner; welding an extension ring to said conductor pipe; sealing the area at said extension ring to prevent or minimize seepage of drilling mud and oil the between said extension ring and said liner into the soil beneath said bottom of said well cellar; disposing a drilling rig above said well cellar and commencing drilling for gas; using said arcuate members as a step for entering and exiting the well cellar; collecting drilling mud and/or oil from said drilling in said well cellar and preventing or minimizing said drilling mud and/or oil from contaminating soil about said well cellar; and removing said drilling mud and/or said oil from said well cellar upon an excessive accumulation of drilling mud and/or oil in said well cellar and preventing or minimizing drilling mud and/or oil from contaminating soil about said well cellar by said drilling mud and or oil from overflowing said well cellar and/or leaking into the soil at the bottom of said well cellar.

One feature or aspect of an embodiment is believed at the time of the filing of this patent application to possibly reside broadly in a method of minimizing leakage of oil and/or drilling mud and/or drilling fluids into the soil about a well cellar of a gas and/or oil well, said method comprising the steps of: installing a sealing structure by: covering a portion of the top surface of the soil surrounding a cylindrical well cellar with a first portion of said sealing structure comprising: a containment material layer that has an opening cut therein substantially matching or following the lip of said well cellar about the top edge of a cylindrical side wall of said well cellar; and lining the side and bottom surfaces of said well cellar with a second portion of said sealing structure comprising: a section of metal pipe that covers and reinforces said cylindrical side wall of said well cellar; a layer of concrete that fills the bottom of said well cellar; a foam ring that is held against an upper portion of said metal pipe by friction or by an adhesive; a skirt of containment material comprising: a lower cylindrical portion configured to cover said upper portion of said metal pipe and said foam ring; and an upper cylindrical portion having a plurality of vertical slits that divide said upper cylindrical portion into a plurality of flaps configured to be folded outwardly, inserted under said containment material layer, and then joined to said containment material layer to form a substantially seamless transition from said containment material layer to said lower cylindrical portion; and installing a sealing band, which sealing band comprises a sealing ring, by: placing said sealing ring against said second portion of said sealing structure by positioning said sealing ring against said foam ring with a portion of said lower, cylindrical portion of said skirt between said sealing ring and said foam ring, which sealing band comprises first, second, and third, arcuate members, each comprising at least two threaded studs disposed at a first end and at least two holes disposed at a second end opposite said first end, which arcuate members are configured to be joined by: connecting said first arcuate member to said second arcuate member by inserting said at least two threaded studs of said first arcuate member into said at least two holes of said second arcuate member; connecting said second arcuate member to said third arcuate member by inserting said at least two threaded studs of said second arcuate member into said at least two holes of said third arcuate member; and connecting said third arcuate member to said first arcuate member by inserting said at least two threaded studs of said third arcuate member into said at least two holes of said first arcuate member; and then expanding said sealing ring by: adjusting a nut on one of said threaded studs of one of said arcuate members against the surface surrounding the corresponding hole in said second end of an adjoining one of said arcuate members; and repeating adjusting of additional nuts as needed to achieve a desired expansion of said sealing ring and thus a desired pressing force of said sealing ring against said foam ring; and thereby pressing, holding, and at least assisting in sealing said second portion of said sealing structure.

Another feature or aspect of an embodiment is believed at the time of the filing of this patent application to possibly reside broadly in the method, wherein said method further comprises installing support structures configured to provide additional support to said sealing ring, to thereby assist in minimizing dislodging or movement of said sealing ring from its installed position in said well cellar, by connecting three support structures to said three arcuate members, one support structure for each of said three arcuate members, each of which support structures comprises: an elongated body of sufficient length to extend from its arcuate member to said concrete floor of said well cellar; a connecting portion disposed at one end of said elongated body and configured to connect said support structure to its corresponding arcuate member; and a foot portion disposed at an opposite end of said elongated body and configured to contact said concrete floor.

Yet another feature or aspect of an embodiment is believed at the time of the filing of this patent application to possibly reside broadly in sealing kit for performing the method, said sealing kit comprising: a foam ring configured to be held against an upper portion of a cylindrical side wall of a well cellar by friction or by an adhesive; a skirt of containment material comprising: a lower cylindrical portion configured to cover the upper portion of the cylindrical side wall and said foam ring upon installation of said skirt; and an upper cylindrical portion having a plurality of vertical slits that divide said upper cylindrical portion into a plurality of flaps configured to be folded outwardly, inserted under a containment material layer disposed on top of the soil surrounding a well cellar, and then joined to the containment material layer to form a substantially seamless transition from the containment material layer to said lower cylindrical portion; a sealing ring configured to be placed against said foam ring with a portion of said lower, cylindrical portion of said skirt between said sealing ring and said foam ring; said sealing ring comprising first, second, and third, arcuate members, each comprising at least two threaded studs disposed at a first end and at least two holes disposed at a second end opposite said first end, which arcuate members are configured to be joined by: connecting said first arcuate member to said second arcuate member by inserting said at least two threaded studs of said first arcuate member into said at least two holes of said second arcuate member; connecting said second arcuate member to said third arcuate member by inserting said at least two threaded studs of said second arcuate member into said at least two holes of said third arcuate member; and connecting said third arcuate member to said first arcuate member by inserting said at least two threaded studs of said third arcuate member into said at least two holes of said first arcuate member; and each of said arcuate members comprises a plurality of nuts, one disposed on each of said threaded studs; said sealing ring is configured to be expanded by: adjusting one of said nuts on one of said threaded studs of one of said arcuate members against the surface surrounding the corresponding hole in said second end of an adjoining one of said arcuate members; and repeating adjusting of additional nuts as needed to achieve a desired expansion of said sealing ring and thus a desired pressing force of said sealing ring against said foam ring.

Still another feature or aspect of an embodiment is believed at the time of the filing of this patent application to possibly reside broadly in the sealing kit, wherein said sealing kit further comprises three support structures configured to provide additional support to said sealing ring, to thereby assist in minimizing dislodging or movement of said sealing ring from its installed position in said well cellar, wherein: said three support structures are configured to be connected to said three arcuate members, one support structure for each of said three arcuate members; each of said support structures comprises: an elongated body of sufficient length to extend from its arcuate member to a floor of a well cellar upon installation; a connecting portion disposed at one end of said elongated body and configured to connect said support structure to its corresponding arcuate member; and a foot portion disposed at an opposite end of said elongated body and configured to contact a floor of a well cellar upon installation.

One feature or aspect of an embodiment is believed at the time of the filing of this patent application to possibly reside broadly in a method of minimizing leakage of oil and/or drilling mud and/or drilling fluids into the soil about a well cellar of a gas and/or oil well, said method comprising the steps of: installing a sealing structure by: covering a portion of the top surface of the soil surrounding a well cellar with a first portion of said sealing structure comprising a containment material layer; and lining the interior surfaces of said well cellar with a second portion of said sealing structure comprising: a side layer that covers a side wall of said well cellar; a floor layer that covers a bottom of said well cellar; a resilient ring that is held against said side layer by friction or by an adhesive; and an additional layer of containment material joined to said containment material layer and configured to cover an upper portion of said side layer; installing a sealing band, which sealing band comprises a sealing ring, by placing said sealing ring against said second portion of said sealing structure by positioning said sealing ring against said resilient ring with a portion of said additional layer of containment material between said sealing ring and said resilient ring, which sealing ring comprises a plurality of arcuate members connected to one another; and then expanding said sealing ring by adjusting an adjusting structure disposed at the connection between two of said arcuate members, and thereby pressing, holding, and at least assisting in sealing said second portion of said sealing structure.

Another feature or aspect of an embodiment is believed at the time of the filing of this patent application to possibly reside broadly in the method, wherein said method further comprises installing support structures configured to provide additional support to said sealing ring, to thereby assist in minimizing dislodging or movement of said sealing ring from its installed position in said well cellar, by connecting support structures to said arcuate members, at least one support structure for each of said arcuate members, each of which support structures comprises: an elongated body of sufficient length to extend from its arcuate member to one of: said floor layer of said well cellar, and the top surface of the soil surrounding said well cellar; a connecting portion disposed at one end of said elongated body and configured to connect its support structure to its corresponding arcuate member; and a support portion disposed at an opposite end of said elongated body and configured to contact one of: said floor layer of said well cellar, and the top surface of said containment layer surrounding said well cellar.

Yet another feature or aspect of an embodiment is believed at the time of the filing of this patent application to possibly reside broadly in the method, wherein said step of connecting each of said support structures to said arcuate members comprises: inserting threaded bolts through a slot in said connecting portion of said support structure and then into receiving holes in a corresponding one of said arcuate members; adjusting said support structure such that said support portion, which comprises a support foot, is disposed in contact with said floor layer of said well cellar; and tightening said threaded bolts to affix said connecting portion, and thus said support structure, to its corresponding arcuate member in a desired position such that said support structure provides additional support to said sealing ring from below said sealing ring.

Still another feature or aspect of an embodiment is believed at the time of the filing of this patent application to possibly reside broadly in the method, wherein: said containment material layer has an opening therein that essentially matches or follows the lip of said well cellar about the top edge of said well cellar; said additional layer of containment material joined to said containment material layer comprises a skirt; said skirt comprises: a lower cylindrical portion; and an upper cylindrical portion having a plurality of vertical slits that divide said upper cylindrical portion into a plurality of flaps configured to be folded outwardly; and said step of lining the interior surface of said well cellar comprises: inserting said lower cylindrical portion of said skirt into said well cellar and over said resilient ring; inserting said flaps between the top surface of the soil surrounding said well cellar and said containment material layer; and joining said containment material layer and said skirt to form a substantially seamless transition from said containment material layer to said lower cylindrical portion of said skirt.

A further feature or aspect of an embodiment is believed at the time of the filing of this patent application to possibly reside broadly in the method, wherein: said containment material layer has an opening therein having a smaller diameter than the diameter of said well cellar; said additional layer of containment material joined to said containment material layer comprises a cylindrical band of containment material having a similar diameter as said well cellar; said step of lining the interior surface of said well cellar comprises: cutting notches or slits in said containment material layer that extend to the lip of said well cellar about the top edge of said well cellar, and thereby forming flaps that extend down into said well cellar; positioning said cylindrical band of containment material between said flaps and said side layer; and joining said flaps and said cylindrical band of containment material to form a substantially seamless transition of said containment material layer over the lip of said well cellar.

Another feature or aspect of an embodiment is believed at the time of the filing of this patent application to possibly reside broadly in the method, wherein said step of connecting each of said support structures to said arcuate members comprises: inserting threaded bolts through a slot in said connecting portion of said support structure and then into receiving holes in a corresponding one of said arcuate members; adjusting said support structure such that said support portion, which comprises a bracket structure, is disposed in contact with the top surface of said containment layer surrounding said well cellar; and tightening said threaded bolts to affix said connecting portion, and thus said support structure, to its corresponding arcuate member in a desired position such that said support structure provides additional support to said sealing ring from above said sealing ring.

Still another feature or aspect of an embodiment is believed at the time of the filing of this patent application to possibly reside broadly in the method, wherein: said containment material layer has an opening therein that essentially matches or follows the lip of said well cellar about the top edge of said well cellar; said additional layer of containment material joined to said containment material layer comprises a skirt; said skirt comprises: a lower cylindrical portion; and an upper cylindrical portion having a plurality of vertical slits that divide said upper cylindrical portion into a plurality of flaps configured to be folded outwardly; and said step of lining the interior surface of said well cellar comprises: inserting said lower cylindrical portion of said skirt into said well cellar and over said resilient ring; inserting said flaps between the top surface of the soil surrounding said well cellar and said containment material layer; and joining said containment material layer and said skirt to form a substantially seamless transition from said containment material layer to said lower cylindrical portion of said skirt.

Yet another feature or aspect of an embodiment is believed at the time of the filing of this patent application to possibly reside broadly in the method, wherein: said containment material layer has an opening therein having a smaller diameter than the diameter of said well cellar; said additional layer of containment material joined to said containment material layer comprises a cylindrical band of containment material having a similar diameter as said well cellar; said step of lining the interior surface of said well cellar comprises: cutting notches or slits in said containment material layer that extend to the lip of said well cellar about the top edge of said well cellar, and thereby forming flaps that extend down into said well cellar; positioning said cylindrical band of containment material between said flaps and said side layer; and joining said flaps and said cylindrical band of containment material to form a substantially seamless transition of said containment material layer over the lip of said well cellar.

A further feature or aspect of an embodiment is believed at the time of the filing of this patent application to possibly reside broadly in a sealing kit for performing the method, said sealing kit comprising: a resilient ring configured to be held against a side layer of a sealing structure in a well cellar by friction or by an adhesive; a skirt of containment material comprising: a lower cylindrical portion configured to cover said resilient ring upon installation of said skirt; and an upper cylindrical portion having a plurality of vertical slits that divide said upper cylindrical portion into a plurality of flaps configured to be folded outwardly, inserted under a containment material layer disposed on top of the soil surrounding a well cellar, and then joined to the containment material layer to form a substantially seamless transition from the containment material layer to said lower cylindrical portion; a sealing ring configured to be placed against said resilient ring with a portion of said lower, cylindrical portion of said skirt between said sealing ring and said resilient ring; said sealing ring comprising a plurality of arcuate members connected to one another; each of said arcuate members comprises an adjusting structure configured to be disposed at the connection between two of said arcuate members; said sealing ring is configured to be expanded by: adjusting one of said adjusting structures of one of said arcuate members, and thereby increasing the spacing between two connected arcuate members; and repeating adjusting of additional adjusting structures as needed to achieve a desired expansion of said sealing ring and thus a desired pressing force of said sealing ring against said foam ring.

Another feature or aspect of an embodiment is believed at the time of the filing of this patent application to possibly reside broadly in the sealing kit for performing the method, wherein said sealing kit further comprises support structures configured to provide additional support to said sealing ring, to thereby assist in minimizing dislodging or movement of said sealing ring from its installed position in said well cellar, wherein: said support structures are configured to be connected to said arcuate members; each of said support structures comprises: an elongated body of sufficient length to extend from its arcuate member to one of: said floor layer of said well cellar, and the top surface of the soil surrounding said well cellar; a connecting portion disposed at one end of said elongated body and configured to connect its support structure to its corresponding arcuate member; and a support portion disposed at an opposite end of said elongated body and configured to contact one of: said floor layer of said well cellar, and the top surface of said containment layer surrounding said well cellar.

Yet another feature or aspect of an embodiment is believed at the time of the filing of this patent application to possibly reside broadly in the sealing kit for performing the method, wherein: said connecting portion of each of said support structures comprises at least one slot configured to permit adjustment of the vertical position of its support structure; said support portion of each of said support structures comprises a support foot; each of said arcuate members comprises a plurality of receiving holes; said kit further comprises threaded bolts configured to be inserted through said slots in said connecting portions of said support structures and then into said receiving holes of said arcuate members to connect said support structures to said arcuate members; each of said support structures is configured to be adjusted by sliding said support structure vertically using said slot until said support foot is disposed in contact with a floor layer of a well cellar; and said threaded bolts are configured to be tightened to affix said connecting portion, and thus said support structure, to its corresponding arcuate member in a desired position such that said support structure provides additional support to said sealing ring from below said sealing ring.

Still another feature or aspect of an embodiment is believed at the time of the filing of this patent application to possibly reside broadly in the sealing kit for performing the method, wherein: said connecting portion of each of said support structures comprises at least one slot configured to permit adjustment of the vertical position of its support structure; said support portion of each of said support structures comprises a support bracket; each of said arcuate members comprises a plurality of receiving holes; said kit further comprises threaded bolts configured to be inserted through said slots in said connecting portions of said support structures and then into said receiving holes of said arcuate members to connect said support structures to said arcuate members; each of said support structures is configured to be adjusted by sliding said support structure vertically using said slot until said support bracket is disposed substantially parallel to and in contact with the top surface of the soil surrounding a well cellar; and said threaded bolts are configured to be tightened to affix said connecting portion, and thus said support structure, to its corresponding arcuate member in a desired position such that said support structure provides additional support to said sealing ring from above said sealing ring.

One feature or aspect of an embodiment is believed at the time of the filing of this patent application to possibly reside broadly in a method of minimizing leakage of oil and/or drilling mud and/or drilling fluids into the soil about a well cellar of a gas and/or oil well, said method comprising the steps of: installing a sealing structure by covering a portion of the top surface of the soil surrounding a well cellar with a first portion of said sealing structure, and by lining the side and bottom surfaces of said well cellar with a second portion of said sealing structure; and installing an expandable sealing band by placing said expandable sealing band against said second portion of said sealing structure at at least one side surface of said well cellar, then expanding said expandable sealing band and thereby pressing, holding, and at least assisting in sealing said second portion of said sealing structure.

Another feature or aspect of an embodiment is believed at the time of the filing of this patent application to possibly reside broadly in the method, wherein said method further comprises installing support structures configured to provide additional support to said sealing band, to thereby assist in minimizing dislodging or movement of said sealing band from its installed position in said well cellar.

Yet another feature or aspect of an embodiment is believed at the time of the filing of this patent application to possibly reside broadly in a sealing kit for performing the method, said sealing kit comprising: a sealing structure comprising: a first portion configured to cover a portion of the top surface of the soil surrounding a well cellar, and a second portion configured to line the side and bottom surfaces of the well cellar; and a sealing band configured to be placed against said second portion of said sealing structure at least one side surface of a well cellar, said sealing band being expandable to thereby press, hold, and at least assist in sealing said second portion of said sealing structure.

Still another feature or aspect of an embodiment is believed at the time of the filing of this patent application to possibly reside broadly in the sealing kit for performing the method, wherein said sealing kit further comprises support structures configured to be installed to provide additional support to said sealing band, to thereby assist in minimizing dislodging or movement of said sealing band from its installed position in a well cellar.

The components disclosed in the various publications, disclosed or incorporated by reference herein, may possibly be used in possible embodiments of the present invention, as well as equivalents thereof.

The purpose of the statements about the technical field is generally to enable the Patent and Trademark Office and the public to determine quickly, from a cursory inspection, the nature of this patent application. The description of the technical field is believed, at the time of the filing of this patent application, to adequately describe the technical field of this patent application. However, the description of the technical field may not be completely applicable to the claims as originally filed in this patent application, as amended during prosecution of this patent application, and as ultimately allowed in any patent issuing from this patent application. Therefore, any statements made relating to the technical field are not intended to limit the claims in any manner and should not be interpreted as limiting the claims in any manner.

The appended drawings in their entirety, including all dimensions, proportions and/or shapes in at least one embodiment of the invention, are accurate and are hereby included by reference into this specification.

The background information is believed, at the time of the filing of this patent application, to adequately provide background information for this patent application. However, the background information may not be completely applicable to the claims as originally filed in this patent application, as amended during prosecution of this patent application, and as ultimately allowed in any patent issuing from this patent application. Therefore, any statements made relating to the background information are not intended to limit the claims in any manner and should not be interpreted as limiting the claims in any manner.

All, or substantially all, of the components and methods of the various embodiments may be used with at least one embodiment or all of the embodiments, if more than one embodiment is described herein.

The purpose of the statements about the object or objects is generally to enable the Patent and Trademark Office and the public to determine quickly, from a cursory inspection, the nature of this patent application. The description of the object or objects is believed, at the time of the filing of this patent application, to adequately describe the object or objects of this patent application. However, the description of the object or objects may not be completely applicable to the claims as originally filed in this patent application, as amended during prosecution of this patent application, and as ultimately allowed in any patent issuing from this patent application. Therefore, any statements made relating to the object or objects are not intended to limit the claims in any manner and should not be interpreted as limiting the claims in any manner.

All of the patents, patent applications and publications recited herein, and in the Declaration attached hereto, are hereby incorporated by reference as if set forth in their entirety herein except for the exceptions indicated herein.

The summary is believed, at the time of the filing of this patent application, to adequately summarize this patent application. However, portions or all of the information contained in the summary may not be completely applicable to the claims as originally filed in this patent application, as amended during prosecution of this patent application, and as ultimately allowed in any patent issuing from this patent application. Therefore, any statements made relating to the summary are not intended to limit the claims in any manner and should not be interpreted as limiting the claims in any manner.

It will be understood that the examples of patents, published patent applications, and other documents which are included in this application and which are referred to in paragraphs which state "Some examples of . . . which may possibly be used in at least one possible embodiment of the present application . . . " may possibly not be used or useable in any one or more embodiments of the application.

The sentence immediately above relates to patents, published patent applications and other documents either incorporated by reference or not incorporated by reference.

Some examples of drilling muds which may possibly be utilized or adapted for use with at least one possible embodiment of the present application may possibly be found in the following U.S. Pat. No. 7,497,262, having the title "High performance water-based drilling mud and method of use," issued on Mar. 3, 2009; U.S. Pat. No. 7,514,389, having the title "High performance water-based drilling mud and method of use," issued on Apr. 7, 2009; U.S. Pat. No. 7,799,741, having the title "Drilling mud containing hydrophobin," issued on Sep. 21, 2010; U.S. Pat. No. 7,192,907, having the title "High performance water-based drilling mud and method of use," issued on Mar. 20, 2007; U.S. Pat. No. 7,320,951, having the title "Silica-based drilling mud comprising glycoside lubricants with amino-linked alkyl chains," issued on Jan. 22, 2008; and U.S. Pat. No. 6,831,043, having the title "High performance water based drilling mud and method of use," issued on Dec. 14, 2004.

Some examples of drilling rigs and methods of drilling which may possibly be utilized or adapted for use in at least one possible embodiment of the present application may possibly be found in one of the following U.S. Pat. No. 7,819,207, having the title "MOBILE LAND DRILLING RIG AND METHOD OF INSTALLATION," issued on Oct. 16, 2010; and U.S. Pat. No. 6,981,855, having the title "DRILLING RIG HAVING A COMPACT COMPRESSOR/PUMP ASSEMBLY," issued on Jan. 3, 2006.

The following U.S. patents are herein incorporated by reference as if set forth in their entirety except for the exceptions indicated herein: U.S. Pat. No. 6,286,593, having the title "OILWELL LEAK CONTAINMENT APPARATUS FOR A COMPLETED OILWELL," issued on Sep. 11, 2001; U.S. Pat. No. 7,637,692, having the title "SEALED WELL CELLAR," issued on Dec. 29, 2009; U.S. Pat. No. 3,940,940, having the title "PROTECTION METHOD," issued on Mar. 2, 1976; U.S. Pat. No. 4,765,775, having the title "DIKE ASSEMBLY," issued on Aug. 23, 1988; U.S. Pat. No. 5,098,220, having the title "MEMBRANE LINER FOR CASINGHEAD OF OIL WELL OF THE LIKE," issued on Mar. 24, 1992; U.S. Pat. No. 5,211,244, having the title "APPARATUS AND METHOD FOR CONTAINING FLUIDS AROUND A WELLHEAD," issued on May 18, 1993; No. 5,228,506, having the title "SPILL COLLECTION SYSTEM FOR WELLHEADS," issued on Jul. 20, 1993; U.S. Pat. No. 5,477,920, having the title "MEMBRANE LINER FOR CASING HEAD OF OIL WELLS AND THE LIKE AND METHOD OF USE THEREFORE," issued on Dec. 16, 1995; No. 5,441,108, having the title "FLUID SPILL CATCHING, CONTAINING, COLLECTION AND RECOVERY SYSTEM FOR WELLHEADS," issued on Aug. 15, 1995; U.S. Pat. No. 8,127,837, having the title "SEALED WELL CELLAR," issued on Mar. 6, 2012; and No. Re. 35,272, having the title "APPARATUS AND METHOD FOR LINING LANDFILLS, RESERVOIRS, HAZARDOUS WASTE DISPOSAL SITES AND THE LIKE," issued on Jun. 11, 1996.

U.S. provisional patent application 61/668,594, filed on Jul. 6, 2012, having inventor Ryan GIBSON, and title A METHOD OF DRILLING AND OPERATING AN OIL OR GAS WELL, A METHOD OF PREVENTING OR MINIMIZING CONTAMINATION TO THE SOIL ABOUT AN OIL OR GAS WELL, USING A KIT TO INSTALL, AN IMPERVIOUS AND REUSABLE LINER AND APPARATUS THEREFOR, is hereby incorporated by reference as if set forth in their entirety herein.

U.S. provisional patent application 61/783,004, filed on Mar. 14, 2013, having inventor Ryan GIBSON, and title A METHOD OF DRILLING AND OPERATING AN OIL OR GAS WELL, A METHOD OF PREVENTING OR MINIMIZING CONTAMINATION TO THE SOIL ABOUT AN OIL OR GAS WELL, USING A KIT TO INSTALL, AN IMPERVIOUS AND REUSABLE LINER AND APPARATUS THEREFOR, is hereby incorporated by reference as if set forth in their entirety herein.

U.S. patent application Swer. No. 13/795,757, filed on Mar. 12, 2013, having inventor Ryan GIBSON, and title A METHOD OF DRILLING AND OPERATING AN OIL OR GAS WELL, A METHOD OF PREVENTING OR MINIMIZING CONTAMINATION TO THE SOIL ABOUT AN OIL OR GAS WELL, USING A KIT TO INSTALL, AN IMPERVIOUS AND REUSABLE LINER AND APPARATUS THEREFOR, is hereby incorporated by reference as if set forth in their entirety herein.

U.S. patent application Ser. No. 13/826,602, filed on Mar. 14, 2013, having inventor Ryan GIBSON, and title A METHOD OF DRILLING AND OPERATING AN OIL OR GAS WELL, A METHOD OF PREVENTING OR MINIMIZING CONTAMINATION TO THE SOIL ABOUT AN OIL OR GAS WELL, USING A KIT TO INSTALL, AN IMPERVIOUS AND REUSABLE LINER AND APPARATUS THEREFOR, is hereby incorporated by reference as if set forth in their entirety herein.

Any and all of the patents, patent applications or patent publications, except for the exceptions indicated herein, listed in the present application are herein incorporated by reference as if set forth in their entirety except for the exceptions indicated herein. The purpose of incorporating U.S. patents, Foreign patents, publications, etc. is solely to provide additional information relating to technical features of one or more embodiments, which information may not be completely disclosed in the wording in the pages of this application. However, words relating to the opinions and judgments of the author and not directly relating to the technical details of the description of the embodiments therein are not incorporated by reference. The words all, always, absolutely, consistently, preferably, guarantee, particularly, constantly, ensure, necessarily, immediately, endlessly, avoid, exactly, continually, expediently, ideal, need, must, only, perpetual, precise, perfect, require, requisite, simultaneous, total, unavoidable, and unnecessary, or words substantially equivalent to the above-mentioned words in this sentence, when not used to describe technical features of one or more embodiments of the patents, patent applications, and patent publications, are not considered to be incorporated by reference herein.

All of the references and documents cited in any of the documents cited herein, except for the exceptions indicated herein, are hereby incorporated by reference as if set forth in their entirety herein except for the exceptions indicated herein. All of the documents cited herein, referred to in the immediately preceding sentence, include all of the patents, patent applications and publications cited anywhere in the present application.

The description of the embodiment or embodiments is believed, at the time of the filing of this patent application, to adequately describe the embodiment or embodiments of this patent application. However, portions of the description of the embodiment or embodiments may not be completely applicable to the claims as originally filed in this patent application, as amended during prosecution of this patent application, and as ultimately allowed in any patent issuing from this patent application. Therefore, any statements made relating to the embodiment or embodiments are not intended to limit the claims in any manner and should not be interpreted as limiting the claims in any manner.

The details in the patents, patent applications and publications may be considered to be incorporable, at applicant's option, into the claims during prosecution as further limitations in the claims to patentably distinguish any amended claims from any applied prior art.

The purpose of the title of this patent application is generally to enable the Patent and Trademark Office and the public to determine quickly, from a cursory inspection, the nature of this patent application. The title is believed, at the time of the filing of this patent application, to adequately reflect the general nature of this patent application. However, the title may not be completely applicable to the technical field, the object or objects, the summary, the description of the embodiment or embodiments, and the claims as originally filed in this patent application, as amended during prosecution of this patent application, and as ultimately allowed in any patent issuing from this patent application. Therefore, the title is not intended to limit the claims in any manner and should not be interpreted as limiting the claims in any manner.

The abstract of the disclosure is submitted herewith as required by 37 C.F.R. §1.72(b). As stated in 37 C.F.R. §1.72 (b):

> A brief abstract of the technical disclosure in the specification must commence on a separate sheet, preferably following the claims, under the heading "Abstract of the Disclosure." The purpose of the abstract is to enable the Patent and Trademark Office and the public generally to determine quickly from a cursory inspection the nature and gist of the technical disclosure. The abstract shall not be used for interpreting the scope of the claims.

Therefore, any statements made relating to the abstract are not intended to limit the claims in any manner and should not be interpreted as limiting the claims in any manner.

The embodiments of the invention described herein above in the context of the preferred embodiments are not to be taken as limiting the embodiments of the invention to all of the provided details thereof, since modifications and variations thereof may be made without departing from the spirit and scope of the embodiments of the invention.

What is claimed is:

1. A method of minimizing leakage of at least one of: oil, drilling mud, and drilling fluids, into soil about a well cellar of a gas well or an oil well, said method comprising the steps of:

installing a sealing structure by:

covering a portion of a top surface of soil surrounding a well cellar with a first portion of said sealing structure comprising a containment material layer; and lining interior surfaces of said well cellar with a second portion of said sealing structure comprising:

a side layer that covers a side wall of said well cellar;

a floor layer that covers a bottom of said well cellar;

a resilient ring that is held against said side layer by friction or by an adhesive; and an additional layer of containment material joined to said containment material layer and configured to cover an upper portion of said side layer;

installing a sealing band, which sealing band comprises a sealing ring, by placing said sealing ring against said second portion of said sealing structure by positioning said sealing ring against said resilient ring with a portion of said additional layer of containment material between said sealing ring and said resilient ring, which sealing ring comprises a plurality of arcuate members connected to one another; and then expanding said sealing ring by adjusting an adjusting structure disposed at the connection between two of said arcuate members, and thereby pressing, holding, and at least assisting in sealing said second portion of said sealing structure.

2. The method according to claim 1, wherein:

said well cellar comprises a cylindrical well cellar;

said containment material layer has an opening cut therein substantially matching or following a lip of said well cellar about a top edge of a cylindrical side wall of said well cellar;

said interior surfaces of said well cellar comprise side and bottom surfaces;

said side layer of said sealing structure:

comprises a section of metal pipe that covers and reinforces said cylindrical side wall of said well cellar;

said floor layer of said sealing structure comprises concrete that fills the bottom of said well cellar;

said resilient ring comprises a foam ring that is held against an upper portion of said metal pipe by friction or by an adhesive;

said additional layer of containment material comprises a skirt comprising:

a lower cylindrical portion configured to cover said upper portion of said metal pipe and said foam ring; and an upper cylindrical portion having a plurality of vertical slits that divide said upper cylindrical portion into a plurality of flaps configured to be folded outwardly, inserted under said containment material layer, and then joined to said containment material layer to form a substantially seamless transition from said containment material layer to said lower cylindrical portion;

said sealing ring comprises first, second, and third arcuate members, each comprising at least two threaded studs disposed at a first end and at least two holes disposed at a second end opposite said first end, which arcuate members are configured to be joined by:

connecting said first arcuate member to said second arcuate member by inserting said at least two threaded studs of said first arcuate member into said at least two holes of said second arcuate member;

connecting said second arcuate member to said third arcuate member by inserting said at least two threaded studs of said second arcuate member into said at least two holes of said third arcuate member; and connecting said third arcuate member to said first arcuate member by inserting said at least two threaded studs of said third arcuate member into said at least two holes of said first arcuate member;

said step of adjusting an adjusting structure disposed at the connection between two of said arcuate members comprises adjusting a nut on one of said threaded studs of one of said arcuate members against the surface surrounding the corresponding hole in said second end of an adjoining one of said arcuate members; and said step of expanding said sealing ring further comprises repeating adjusting of additional nuts as needed to achieve a desired expansion of said sealing ring and thus a desired pressing force of said sealing ring against said foam ring.

3. The method according to claim 2, wherein said method further comprises installing support structures configured to provide additional support to said sealing ring, to thereby assist in minimizing dislodging or movement of said sealing ring from its installed position in said well cellar, by connecting three support structures to said three arcuate members, one support structure for each of said three arcuate members, each of which support structures comprises:

an elongated body of sufficient length to extend from its arcuate member to said concrete floor of said well cellar;

a connecting portion disposed at one end of said elongated body and configured to connect said support structure to its corresponding arcuate member; and a foot portion disposed at an opposite end of said elongated body and configured to contact said concrete floor.

4. A sealing kit for performing the method according to claim 2, said sealing kit comprising:

a foam ring configured to be held against an upper portion of a cylindrical side wall of a well cellar by friction or by an adhesive;

a skirt of containment material comprising:

a lower cylindrical portion configured to cover the upper portion of the cylindrical side wall and said foam ring upon installation of said skirt; and an upper cylindrical portion having a plurality of vertical slits that divide said upper cylindrical portion into a plurality of flaps configured to be folded outwardly, inserted under a containment material layer disposed on top of the soil surrounding a well cellar, and then joined to the containment material layer to form a substantially seamless transition from the containment material layer to said lower cylindrical portion;

a sealing ring configured to be placed against said foam ring with a portion of said lower, cylindrical portion of said skirt between said sealing ring and said foam ring;

said sealing ring comprising first, second, and third, arcuate members, each comprising at least two threaded studs disposed at a first end and at least two holes disposed at a second end opposite said first end, which arcuate members are configured to be joined by:

connecting said first arcuate member to said second arcuate member by inserting said at least two threaded studs of said first arcuate member into said at least two holes of said second arcuate member;

connecting said second arcuate member to said third arcuate member by inserting said at least two threaded studs of said second arcuate member into said at least two holes of said third arcuate member; and connecting said third arcuate member to said first arcuate member by inserting said at least two threaded studs of said third arcuate member into said at least two holes of said first arcuate member; and each of said arcuate members comprises a plurality of nuts, one disposed on each of said threaded studs;

said sealing ring is configured to be expanded by:

adjusting one of said nuts on one of said threaded studs of one of said arcuate members against the surface surrounding the corresponding hole in said second end of an adjoining one of said arcuate members; and repeating adjusting of additional nuts as needed to achieve a desired expansion of said sealing ring and thus a desired pressing force of said sealing ring against said foam ring.

5. The sealing kit according to claim 4, wherein said sealing kit further comprises three support structures configured to provide additional support to said sealing ring, to thereby assist in minimizing dislodging or movement of said sealing ring from its installed position in said well cellar, wherein:

said three support structures are configured to be connected to said three arcuate members, one support structure for each of said three arcuate members;

each of said support structures comprises:

an elongated body of sufficient length to extend from its arcuate member to a floor of a well cellar upon installation;

a connecting portion disposed at one end of said elongated body and configured to connect said support structure to its corresponding arcuate member; and a foot portion disposed at an opposite end of said elongated body and configured to contact a floor of a well cellar upon installation.

6. The method according to claim 1, wherein said method further comprises installing support structures configured to provide additional support to said sealing ring, to thereby assist in minimizing dislodging or movement of said sealing ring from its installed position in said well cellar, by connecting support structures to said arcuate members, at least one support structure for each of said arcuate members, each of which support structures comprises:

an elongated body of sufficient length to extend from its arcuate member to one of: said floor layer of said well cellar, and the top surface of the soil surrounding said well cellar;

a connecting portion disposed at one end of said elongated body and configured to connect its support structure to its corresponding arcuate member; and a support portion disposed at an opposite end of said elongated body and configured to contact one of: said floor layer of said well cellar, and the top surface of said containment layer surrounding said well cellar.

7. The method according to claim 6, wherein said step of connecting each of said support structures to said arcuate members comprises:

inserting threaded bolts through a slot in said connecting portion of said support structure and then into receiving holes in a corresponding one of said arcuate members;

adjusting said support structure such that said support portion, which comprises a support foot, is disposed in contact with said floor layer of said well cellar; and tightening said threaded bolts to affix said connecting portion, and thus said support structure, to its corresponding arcuate member in a desired position such that said support structure provides additional support to said sealing ring from below said sealing ring.

8. The method according to claim 7, wherein one of (A) and (B):

(A) said containment material layer has an opening therein that essentially matches or follows the lip of said well cellar about the top edge of said well cellar;

said additional layer of containment material joined to said containment material layer comprises a skirt;

said skirt comprises:

a lower cylindrical portion; and an upper cylindrical portion having a plurality of vertical slits that divide said upper cylindrical portion into a plurality of flaps configured to be folded outwardly; and said step of lining the interior surface of said well cellar comprises:

inserting said lower cylindrical portion of said skirt into said well cellar and over said resilient ring;

inserting said flaps between the top surface of the soil surrounding said well cellar and said containment material layer; and joining said containment material layer and said skirt to form a substantially seamless transition from said containment material layer to said lower cylindrical portion of said skirt; and (B) said containment material layer has an opening therein having a smaller diameter than the diameter of said well cellar;

said additional layer of containment material joined to said containment material layer comprises a cylindrical band of containment material having a similar diameter as said well cellar;

said step of lining the interior surface of said well cellar comprises:

cutting notches or slits in said containment material layer that extend to the lip of said well cellar about the top edge of said well cellar, and thereby forming flaps that extend down into said well cellar;

positioning said cylindrical band of containment material between said flaps and said side layer; and joining said flaps and said cylindrical band of containment material to form a substantially seamless transition of said containment material layer over the lip of said well cellar.

9. The method according to claim 6, wherein said step of connecting each of said support structures to said arcuate members comprises:

inserting threaded bolts through a slot in said connecting portion of said support structure and then into receiving holes in a corresponding one of said arcuate members;

adjusting said support structure such that said support portion, which comprises a bracket structure, is disposed in contact with the top surface of said containment layer surrounding said well cellar; and tightening said threaded bolts to affix said connecting portion, and thus said support structure, to its corresponding arcuate member in a desired position such that said support structure provides additional support to said sealing ring from above said sealing ring.

10. The method according to claim 9, wherein one of (C) and (D):

(C) said containment material layer has an opening therein that essentially matches or follows the lip of said well cellar about the top edge of said well cellar;

said additional layer of containment material joined to said containment material layer comprises a skirt;

said skirt comprises:

a lower cylindrical portion; and an upper cylindrical portion having a plurality of vertical slits that divide said upper cylindrical portion into a plurality of flaps configured to be folded outwardly; and said step of lining the interior surface of said well cellar comprises:

inserting said lower cylindrical portion of said skirt into said well cellar and over said resilient ring;

inserting said flaps between the top surface of the soil surrounding said well cellar and said containment material layer; and joining said containment material layer and said skirt to form a substantially seamless transition from said containment material layer to said lower cylindrical portion of said skirt; and (D) said containment material layer has an opening therein having a smaller diameter than the diameter of said well cellar;

said additional layer of containment material joined to said containment material layer comprises a cylindrical band of containment material having a similar diameter as said well cellar;

said step of lining the interior surface of said well cellar comprises:

cutting notches or slits in said containment material layer that extend to the lip of said well cellar about the top edge of said well cellar, and thereby forming flaps that extend down into said well cellar;

positioning said cylindrical band of containment material between said flaps and said side layer; and joining said flaps and said cylindrical band of containment material to form a substantially seamless transition of said containment material layer over the lip of said well cellar.

11. A sealing kit for performing the method according to claim 1, said sealing kit comprising:

a resilient ring configured to be held against a side layer of a sealing structure in a well cellar by friction or by an adhesive;

a skirt of containment material comprising:

a lower cylindrical portion configured to cover said resilient ring upon installation of said skirt; and an upper cylindrical portion having a plurality of vertical slits that divide said upper cylindrical portion into a plurality of flaps configured to be folded outwardly, inserted under a containment material layer disposed on top of the soil surrounding a well cellar, and then joined to the containment material layer to form a substantially seamless transition from the containment material layer to said lower cylindrical portion;

a sealing ring configured to be placed against said resilient ring with a portion of said lower, cylindrical portion of said skirt between said sealing ring and said resilient ring;

said sealing ring comprising a plurality of arcuate members connected to one another;

each of said arcuate members comprises an adjusting structure configured to be disposed at the connection between two of said arcuate members;

said sealing ring is configured to be expanded by:

adjusting one of said adjusting structures of one of said arcuate members, and thereby increasing the spacing between two connected arcuate members; and repeating adjusting of additional adjusting structures as needed to achieve a desired expansion of said sealing ring and thus a desired pressing force of said sealing ring against said foam ring.

12. The sealing kit according to claim 11, wherein said sealing kit further comprises support structures configured to provide additional support to said sealing ring, to thereby assist in minimizing dislodging or movement of said sealing ring from its installed position in said well cellar, wherein:

said support structures are configured to be connected to said arcuate members;

each of said support structures comprises:

an elongated body of sufficient length to extend from its arcuate member to one of: said floor layer of said well cellar, and the top surface of the soil surrounding said well cellar;

a connecting portion disposed at one end of said elongated body and configured to connect its support structure to its corresponding arcuate member; and a support portion disposed at an opposite end of said elongated body and configured to contact one of: said floor layer of said well cellar, and the top surface of said containment layer surrounding said well cellar.

13. The sealing kit according to claim 12, wherein:

said connecting portion of each of said support structures comprises at least one slot configured to permit adjustment of the vertical position of its support structure;

said support portion of each of said support structures comprises a support foot;

each of said arcuate members comprises a plurality of receiving holes;

said kit further comprises threaded bolts configured to be inserted through said slots in said connecting portions of said support structures and then into said receiving holes of said arcuate members to connect said support structures to said arcuate members;

each of said support structures is configured to be adjusted by sliding said support structure vertically using said slot until said support foot is disposed in contact with a floor layer of a well cellar; and said threaded bolts are configured to be tightened to affix said connecting portion, and thus said support structure, to its corresponding arcuate member in a desired position such that said support structure provides additional support to said sealing ring from below said sealing ring.

14. The sealing kit according to claim 12, wherein:

said connecting portion of each of said support structures comprises at least one slot configured to permit adjustment of the vertical position of its support structure;

said support portion of each of said support structures comprises a support bracket;

each of said arcuate members comprises a plurality of receiving holes;

said kit further comprises threaded bolts configured to be inserted through said slots in said connecting portions of said support structures and then into said receiving holes of said arcuate members to connect said support structures to said arcuate members;

each of said support structures is configured to be adjusted by sliding said support structure vertically using said slot until said support bracket is disposed substantially parallel to and in contact with the top surface of the soil surrounding a well cellar; and said threaded bolts are configured to be tightened to affix said connecting portion, and thus said support structure, to its corresponding arcuate member in a desired position such that said support structure provides additional support to said sealing ring from above said sealing ring.

15. A method of minimizing leakage of at least one of: oil, drilling mud, and drilling fluids, into soil about a well cellar of a gas well or an oil well, said method comprising the steps of:

installing a sealing structure by covering a portion of a top surface of soil surrounding a well cellar with a first portion of said sealing structure, and by lining side and bottom surfaces of said well cellar with a second portion of said sealing structure; and installing an expandable sealing ring, comprising a first section and a second section separate from said first section, each being made of metal or other generally inflexible material, by placing said expandable sealing ring against said second portion of said sealing structure at least one side surface of said well cellar, then expanding said expandable sealing ring and increasing the diameter of said expandable sealing ring by adjusting the position of said first section with respect to said second section, and thereby pressing, holding, and at least assisting in sealing said second portion of said sealing structure.

16. The method according to claim 15, wherein said method further comprises installing support structures configured to provide additional support to said sealing ring, to thereby assist in minimizing dislodging or movement of said sealing ring from its installed position in said well cellar.

17. A sealing kit for performing the method according to claim 15, said sealing kit comprising:

said sealing structure comprising: said first portion configured to cover the portion of the top surface of the soil surrounding the well cellar, and said second portion configured to line the side and bottom surfaces of the well cellar;

said sealing ring being configured to be placed against said second portion of said sealing structure at at least one side surface of the well cellar;

said sealing ring comprising said first section and said second section separate from said first section, each being made of metal or other generally inflexible material; and said first section being adjustable to permit adjustment of the position of said first section with respect to said second section, and to permit expansion of said sealing ring and the diameter of said sealing ring to thereby press, hold, and at least assist in sealing said second portion of said sealing structure.

18. The sealing kit according to claim 17, wherein said sealing kit further comprises support structures configured to be installed to provide additional support to said sealing ring, to thereby assist in minimizing dislodging or movement of said sealing ring from its installed position in a well cellar.

19. A method of minimizing leakage of at least one of: oil, drilling mud, and drilling fluids, into soil about a well cellar of a gas well or an oil well, said method comprising the steps of:

installing a sealing structure by covering side and bottom surfaces of a well cellar with said sealing structure; and installing an expandable sealing ring, comprising a first section and a second section separate from said first section, each being made of metal or other generally inflexible material, by placing said expandable sealing ring against a portion of said sealing structure at at least one side surface of said well cellar, then expanding said expandable sealing ring and increasing the diameter of said expandable sealing ring by adjusting the position of said first section with respect to said second section, and thereby pressing, holding, and at least assisting in sealing said portion of said sealing structure.

20. A sealing kit for performing the method according to claim 19, said sealing kit comprising:

said sealing structure configured to line the side and bottom surfaces of the well cellar;

said sealing ring being configured to be placed against said portion of said sealing structure at at least one side surface of the well cellar;

said sealing ring comprising said first section and said second section separate from said first section, each being made of metal or other generally inflexible material; and said first section being adjustable to permit adjustment of the position of said first section with respect to said second section, and to permit expansion of said sealing ring and the diameter of said sealing ring to thereby press, hold, and at least assist in sealing said portion of said sealing structure.

* * * * *